US008761431B1

(12) United States Patent
Jackson

(10) Patent No.: US 8,761,431 B1
(45) Date of Patent: Jun. 24, 2014

(54) ADJUSTABLE HEADPHONES

(71) Applicant: Joelise, LLC, San Bernardino, CA (US)

(72) Inventor: Joel Dewayne Jackson, San Bernardino, CA (US)

(73) Assignee: Joelise, LLC, San Bernardino, CA (US)

( * ) Notice: Subject to any disclaimer, the term of this patent is extended or adjusted under 35 U.S.C. 154(b) by 0 days.

(21) Appl. No.: 13/974,921

(22) Filed: Aug. 23, 2013

Related U.S. Application Data

(60) Provisional application No. 61/866,366, filed on Aug. 15, 2013.

(51) Int. Cl.
*H04R 21/02* (2006.01)

(52) U.S. Cl.
USPC ..... 381/385; 381/367; 381/376; 381/370

(58) Field of Classification Search
USPC ..... 381/367, 376, 370, 385
See application file for complete search history.

(56) References Cited

U.S. PATENT DOCUMENTS

| | | | | |
|---|---|---|---|---|
| 4,070,553 | A | 1/1978 | Hass | |
| 4,084,139 | A | 4/1978 | Jakobe | |
| 4,539,700 | A | 9/1985 | Sato | |
| 4,597,469 | A | 7/1986 | Nagashima | |
| 4,764,962 | A | 8/1988 | Ekman et al. | |
| 4,821,317 | A * | 4/1989 | Wong | 379/430 |
| 4,893,344 | A | 1/1990 | Trägardh et al. | |
| 4,901,355 | A | 2/1990 | Moore | |
| 5,133,428 | A | 7/1992 | Perrson | |
| 5,212,734 | A | 5/1993 | Tsao | |
| 5,272,757 | A | 12/1993 | Scofield et al. | |
| 5,333,206 | A | 7/1994 | Koss | |
| 5,335,285 | A | 8/1994 | Gluz | |

(Continued)

FOREIGN PATENT DOCUMENTS

| | | |
|---|---|---|
| JP | 08-107593 | 4/1996 |
| JP | 2001-285982 | 10/2001 |
| JP | 2012-169067 | 9/2012 |

OTHER PUBLICATIONS

NCredible N-Pulse™ High Performance Over-Ear Headphones by Monster Cable Products, Inc., http://monsterproducts.com/headphones/ncredible/, accessed on Aug. 29, 2013, product available before Aug. 15, 2013.

(Continued)

*Primary Examiner* — Davetta W Goins
*Assistant Examiner* — Amir Etesam
(74) *Attorney, Agent, or Firm* — Knobbe, Martens, Olson & Bear LLP

(57) ABSTRACT

An adjustable headset has a support portion that rests on a user's head when the headset is worn in an upright orientation and rests on a user's neck or shoulders when the headset is worn around the user's neck. The adjustable headset also includes a pair of arm assemblies attached to the support portion and having first arm portions and second arm portions. The adjustable headset also includes a pivoting mechanism that pivotably couples the first and second arm portions. The pivoting mechanism allows the pivoting of the second arm portion relative to the first arm portion so that the second arm portion can be pivoted between a first position where the headset can be worn by the user on their head and a second position when the headset is worn around the user's neck to direct sound at the user's ears.

20 Claims, 21 Drawing Sheets

(56) References Cited

U.S. PATENT DOCUMENTS

| | | | | |
|---|---|---|---|---|
| 5,465,421 | A | 11/1995 | McCormick et al. | |
| 5,953,434 | A | 9/1999 | Boyden | |
| 6,062,337 | A | 5/2000 | Zinserling | |
| 6,130,953 | A * | 10/2000 | Wilton et al. | 381/375 |
| 6,356,644 | B1 | 3/2002 | Pollak | |
| 6,363,158 | B1 | 3/2002 | Lu | |
| 6,763,119 | B2 | 7/2004 | Lee | |
| 6,920,228 | B2 | 7/2005 | Redmer et al. | |
| 6,934,567 | B2 | 8/2005 | Gantz et al. | |
| 6,993,143 | B2 | 1/2006 | Harris et al. | |
| 7,072,483 | B2 | 7/2006 | Lenhard-Backhaus | |
| 7,099,464 | B2 * | 8/2006 | Lucey et al. | 379/430 |
| 7,123,737 | B2 | 10/2006 | Ham | |
| 7,182,459 | B1 | 2/2007 | Chen | |
| 7,388,962 | B2 | 6/2008 | Cheung et al. | |
| 7,519,192 | B1 | 4/2009 | Laycock et al. | |
| 7,697,709 | B2 | 4/2010 | Mei et al. | |
| 8,023,663 | B2 | 9/2011 | Goldberg | |
| 8,155,368 | B2 | 4/2012 | Cheung et al. | |
| 8,391,516 | B2 | 3/2013 | Fletcher | |
| 8,442,238 | B2 | 5/2013 | Franzén | |
| 8,443,467 | B2 * | 5/2013 | Chiang | 2/209 |
| 8,452,039 | B2 | 5/2013 | Wright | |
| 2002/0197960 | A1 | 12/2002 | Lee et al. | |
| 2003/0156730 | A1 | 8/2003 | Wu | |
| 2003/0235321 | A1 | 12/2003 | Lu | |
| 2004/0197001 | A1 | 10/2004 | Terrell | |
| 2007/0133836 | A1 * | 6/2007 | Lee | 381/370 |
| 2007/0217643 | A1 | 9/2007 | Chang | |
| 2007/0223760 | A1 | 9/2007 | Fan | |
| 2007/0253587 | A1 | 11/2007 | Ostrowski | |
| 2008/0019557 | A1 | 1/2008 | Bevirt et al. | |
| 2008/0253554 | A1 | 10/2008 | Chen | |
| 2008/0317274 | A1 | 12/2008 | Kim | |
| 2010/0215198 | A1 | 8/2010 | Ngia et al. | |
| 2011/0206217 | A1 | 8/2011 | Weis | |
| 2012/0288132 | A1 | 11/2012 | Massey | |
| 2013/0044908 | A1 | 2/2013 | Gotlieb | |
| 2013/0115579 | A1 | 5/2013 | Taghavi | |

OTHER PUBLICATIONS

Photo of Mixr™ headphones by Beats Electronics, LLC, available at http://www.beatsbydre.com/headphones/mixr/beats-mixr.html, products available before Aug. 15, 2013.

Photo of Pro headphones by Beats Electronics, LLC, available at http://www.beatsbydre.com/headphones/pro/beats-pro.html, products available before Aug. 15, 2013.

* cited by examiner

ADJUSTABLE HEADPHONES

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This present application claims the benefit of U.S. Provisional Patent Application No. 61/866,366, filed on Aug. 15, 2013 and entitled GAMING HEADPHONES WITH MICROPHONE, CONVERTIBLE TO NECK/SHOULDER POSITION AND PERSONAL USE OF EARS EXTERNAL AUDIO, the entire contents of which are incorporated herein by reference.

BACKGROUND

1. Field

The present application relates to adjustable headphones, and more particularly, to adjustable headphones for use in gaming applications.

2. Description of the Related Art

Gaming is a popular hobby in many countries around the world. Video games have become increasingly complex and allow gamers to play against individuals in the same location (e.g., room) or in remote locations (e.g., different cities or countries) via the internet. In addition to the visual aspects of the video games, sound also plays an important part in providing the gaming experience. Usually, a gamer will wear a headset that provides direct sound to the user's ears, as well as includes a microphone to allow the gamers to communicate with each other.

Gaming enthusiasts can dedicate significant periods of time to playing such interactive games. In some instances, gamers can spend at least 4 hours a week or 10 hours a week playing video games. Additionally, gamers can spend hours (e.g., 2 hours, 4 hours) per sitting playing a game.

One problem with current gaming equipment (e.g., headsets), is that gamers can suffer ear fatigue and discomfort from wearing the headsets for prolonged or extended periods of time (e.g., 2 hours, 4 hours, 6 hours) while playing a game. Another problem with existing headsets is that gamers cannot clearly or readily, and sometimes are unable to, hear ambient sounds while wearing the headset. For example, when wearing the headset, gamers are unable to hear the house phone ring, the doorbell ring, or other people in the room (or other rooms) talking to them. In some instances, to alleviate ear fatigue or allow access to ambient sounds, gamers will remove their headsets from on top of their head and will place them around their neck. However, this diminishes the quality of the gaming experience as the sound from the speakers is directed below the user's head and toward the user's chest and so does not provide the user with the full sound experience of the video game. Moreover, the headset when worn around the neck can be unstable and readily shift or move, requiring the user to constantly adjust the positioning of the headset.

SUMMARY

Accordingly, there is a need for an improved headset that can be worn by a user in multiple configurations to solve the problems identified above.

In accordance with one embodiment, an adjustable headset is provided. The adjustable headset comprises a support portion that rests on a user's head when the headset is worn in an upright orientation and rests on a user's neck or shoulders when the headset is worn around the user's neck. The adjustable headset also includes a pair of arm assemblies attached to the support portion and having first arm portions and second arm portions. The adjustable headset also comprises a pivoting mechanism that pivotably couples the first and second arm portions. The pivoting mechanism allows the pivoting of the second arm portion relative to the first arm portion so that the second arm portion can be pivoted between a first position where the headset can be worn by the user on their head and a second position when the headset is worn around the user's neck to direct sound at the user's ears.

In accordance with another embodiment, an adjustable headset is provided. The adjustable headset comprises a support portion configured to rest on a user's head when the headset is worn in an upright orientation and configured to rest on a user's neck or shoulders when the headset is worn around the user's neck. The adjustable headset also comprises a pair of arm assemblies movably coupled to the support portion, each of the arm assemblies having a speaker at a distal portion thereof. Each of the arm assemblies comprises a first arm portion extending from the support portion to a distal end, a second arm portion extending adjacent the first arm portion, the speaker operatively coupled to a distal portion of the second arm portion, and a pivoting mechanism that movably couples the second arm portion to the first arm portion, the pivoting mechanism configured to allow the pivoting of the second arm portion away from the first arm portion. The second arm portion is selectively pivotable between a first orientation where the first and second arm portions extend generally parallel to each other and a second orientation where the second arm portion extends at a non-parallel angle relative to the first arm portion, such that when the headset is worn around the user's neck and supported by the user's shoulders and/or upper chest, the second arm portions are positionable at said non-parallel angle relative to the first arm portions to position the speakers closer to the user's ears to thereby direct sound at the user's ears.

In accordance with another embodiment, an adjustable headset is provided. The adjustable headset comprises a support portion configured to rest on a user's head when the headset is worn in an upright orientation and configured to rest on a user's neck or shoulders when the headset is worn around the user's neck. The adjustable headset also comprises a pair of arm assemblies movably coupled to the support portion, each of the arm assemblies having a speaker at a distal portion thereof. Each of the arm assemblies comprises a first arm portion extending from the support portion to a distal end, a second arm portion extending adjacent the first arm portion, the speaker operatively coupled to a distal portion of the second arm, and means for pivoting the second arm portions relative to the first arm portions between a first orientation when the headset is worn on the user's head and a second orientation, different than the first orientation, when the headset is worn around the user's neck. When the headset is worn around the user's neck and supported by the user's shoulders and/or upper chest, the second arm portions are positionable so that the speakers are oriented toward the user's ears to thereby direct sound at the user's ears.

In accordance with another embodiment, an adjustable headset is provided. The adjustable headset comprises a support portion configured to rest on a user's head when the headset is worn in an upright orientation and configured to rest on a user's neck or shoulders when the headset is worn around the user's neck. The adjustable headset also comprises a pair of arm assemblies movably coupled to the support portion, each of the arm assemblies having a speaker at a distal portion thereof. Each of the arm assemblies comprises a first arm portion extending distally from the support portion, a second arm portion movably attached to the first arm portion, the speaker operatively coupled to the second arm, and a pivoting mechanism that movably couples the second arm portion to the first arm portion, the pivoting mechanism configured to allow the pivoting of the second arm relative to the first arm portion. The second arm portion is selectively pivotable between a first orientation where the speakers are directed inwardly toward the user's ears when the headset is worn on the user's head and a second orientation different than the first orientation when headset is worn around the user's neck and supported by the user's shoulders and/or upper chest.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting. Like reference numbers and designations in the various drawings indicate like elements.

DETAILED DESCRIPTION

In the following detailed description, reference is made to the accompanying drawings, which form a part of the present disclosure. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of the inventive features illustrated herein, and additional applications of the principles of the inventions as illustrated herein, which would occur to one skilled in the relevant art and having possession of this disclosure, are to be considered within the scope of the invention.

In the embodiments disclosed below, the term "headset" and "headphones" is used interchangeably. Additionally, though the headset disclosed in embodiments below is described in connection with video gaming applications, one of skill in the art will recognize that the headset disclosed in the embodiments below is not limited for use with gaming applications, and can be used in other applications, such as for listening to music (e.g., from a home stereo unit, or a portable music player, such as an smart phone, iPod, etc.), for use with a video player and/or a computing device (e.g., personal computer, laptop computer, tablet computer), and for other audio applications.

Figure 1:
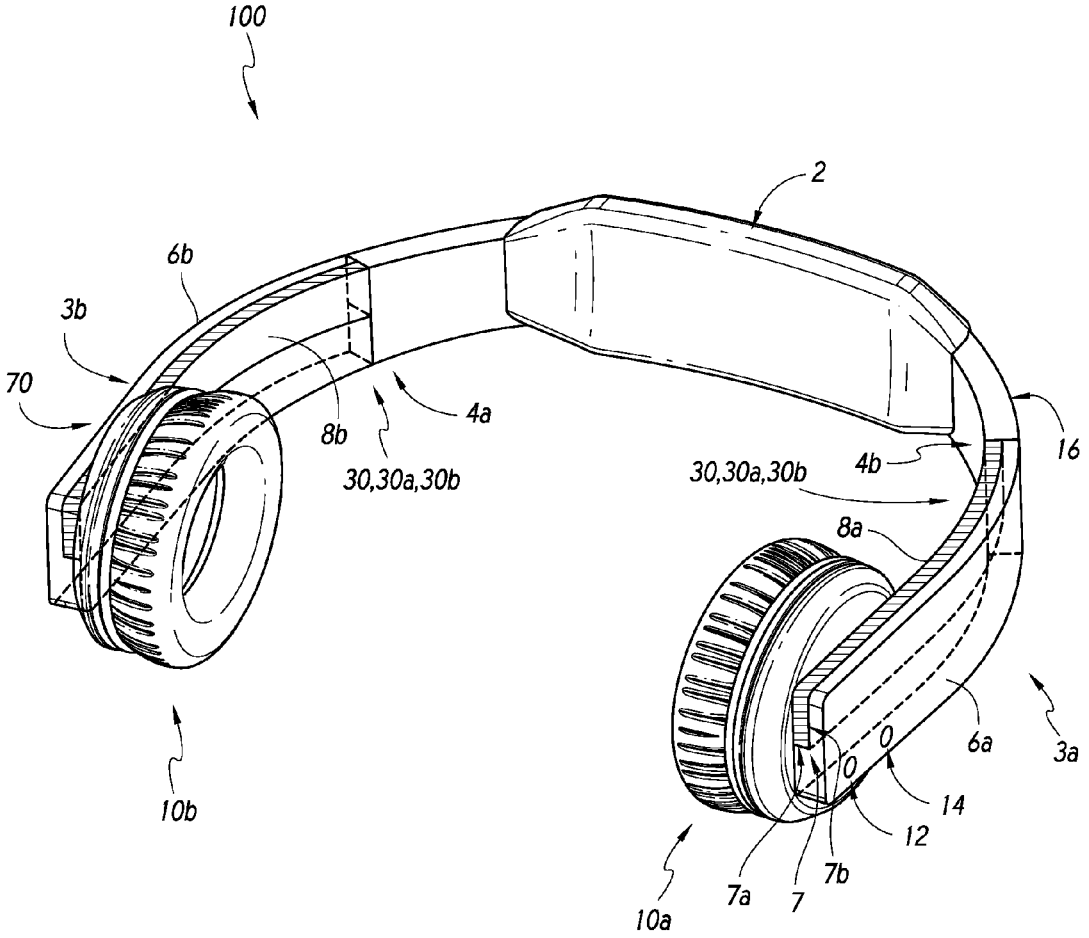
FIG. 1 is a perspective schematic end view of one embodiment of an adjustable headset or headphones.
Figure 2:
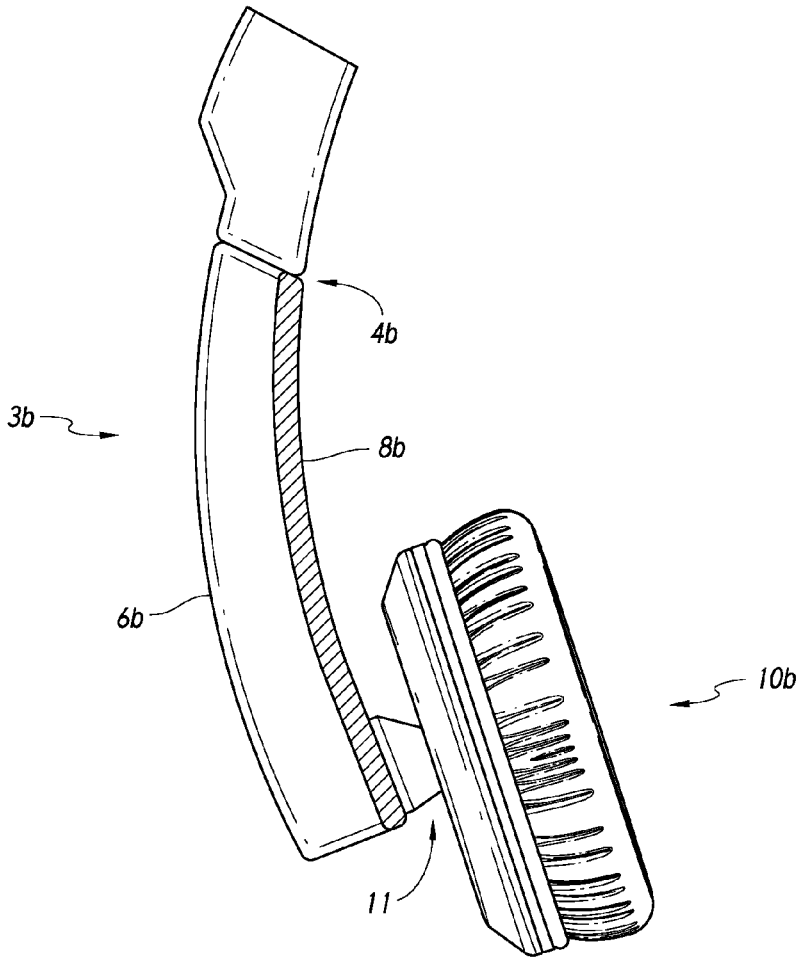
FIG. 2 is a front view of a portion of the adjustable headset of FIG. 1.
Figure 3:
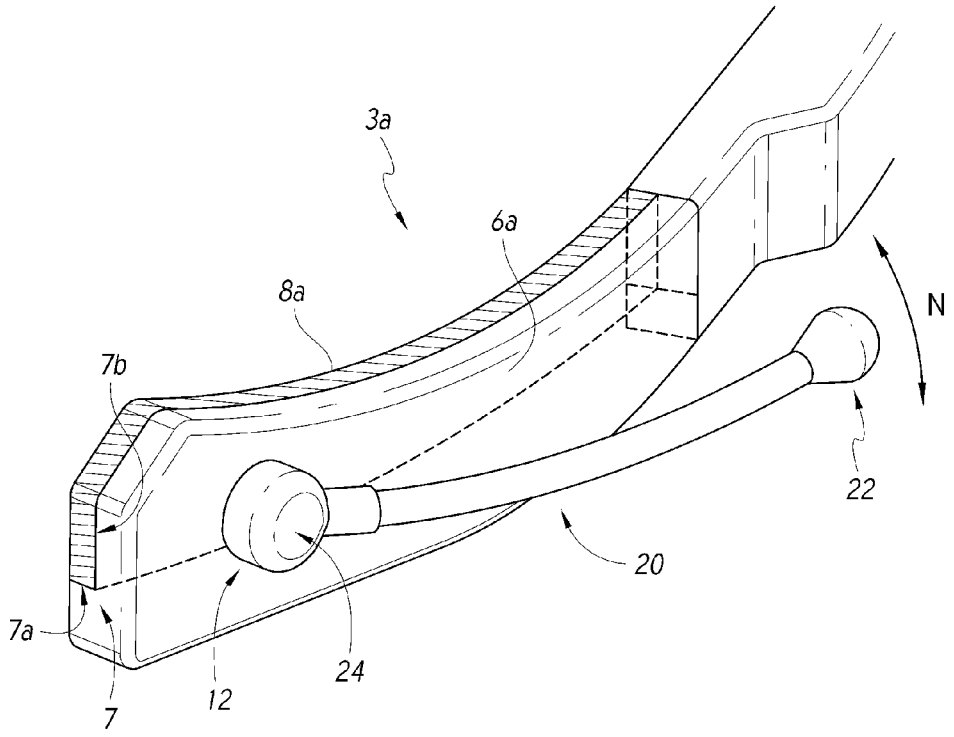
FIG. 3 is a side view of a portion of the adjustable headset of FIG. 1 with a microphone boom attached to an arm of the headset.

FIGS. 1-3 shown one embodiment of an adjustable headset or headphones 100. The headset 100 can have a support portion 2 and two arms 3*a*, 3*b* connected to the support portion 2. Optionally, the arms 3*a*, 3*b* can couple to the support portion 2 via corresponding bridge portions 4*a*, 4*b*.

Optionally, the bridge portions 4*a*, 4*b* can be a part of the support portion 2 (e.g., integrally formed with the support portion 2). Optionally, the arms 3*a*, 3*b* can be slidably adjusted relative to the bridge portions 4*a*, 4*b* to adjust the distance between speakers 10*a*, 10*b* and the support portion to accommodate different head sizes among users (via, for example, the mechanism of FIGS. 13A-13B). The support portion 2 can rest on top of a user's head when the headset 100 is worn on a user's head so that the arms 3*a*, 3*b* extend downward toward the user's ears. When the headset 100 is worn around the user's neck, as discussed further below, the support portion 2 can rest on the user's neck and/or shoulders. In one embodiment, the support portion 2 can include a cushioning member (e.g., a padded portion, such as a foam portion) so that the support portion 2 can comfortably rest on the user's head, neck or shoulders. Optionally, the support portion 2 can be contoured to better fit over the user's head and/or around a user's neck.

With continued reference to FIGS. 1-3, each of the arms 3*a*, 3*b* of the headset 100 can have a first arm portion 6*a*, 6*b* and a second arm portion 8*a*, 8*b*. In the illustrated embodiment, the first arm portion 6*a*, 6*b* is an outer arm member and the second arm portion 8*a*, 8*b* is an inner arm member. However, in other embodiments, the first arm portion 6*a*, 6*b* can be the inner arm member and the second arm portion 8*a*, 8*b* can be the outer arm member. The second arm portion 8*a*, 8*b* is movably (e.g., pivotably) coupled to the first arm portion 6*a*, 6*b* and can be moved (e.g., pivoted) from a retracted position, as shown in FIG. 1, to an extended position, as described further and shown in FIG. 6.

As shown in FIGS. 1 and 3, the first arm portion 6*a*, 6*b* of each of the arms 3*a*, 3*b* can have a shoulder 7 defined by a bottom surface 7*a* and a side surface 7*b* that extend at an angle (e.g., a perpendicular angle, an obtuse angle, an acute angle) relative to each other. Optionally, the angle between the bottom surface 7*a* and the side surface 7*b* of the shoulder 7 can correspond to the angle between a bottom surface and side surface of the second arm portion 8*a*, 8*b*. As shown in FIG. 1, the shoulder 7 can support the second arm portion 8*a*, 8*b* when in the retracted position. Optionally, the dimensions of the shoulder 7 and first arm portion 6*a*, 6*b* are such that when the second arm portion 8*a*, 8*b* is in the retracted position, a width of the arm 3*a*, 3*b* is generally constant from a rear side of the arm 3*a*, 3*b* to a front side of the arm 3*a*, 3*b*.

As best shown in FIG. 2, the second arm portion 8*a*, 8*b* of each of the arms 3*a*, 3*b* supports a speaker 10*a*, 10*b* (e.g., an amplified loud speaker) via a connector 11 that interconnects the second arm portion 8*a*, 8*b* to the speaker 10*a*, 10*b*. As shown in FIG. 1, the headset 100 can optionally include a connection port 12 that can receive a connector for a microphone. Optionally, the microphone can be a filtered microphone that excludes background noise and allows the user to communicate effectively with other users (e.g., other gamers playing the same game online). Optionally, the headset can include a connection port 14 that can receive a connector for an electrical cord (e.g., for providing a wired connection between the headset 100 and the video game console, music player, video player, etc.). Though the connection ports 12, 14 are shown as being on an outer side of the first arm portion 6*a*, one of skill in the art will recognize that the connection ports 12, 14 can be disposed on other surfaces of the headset 100 (e.g., end surfaces of the arms 3*a*, 3*b*, see FIG. 11). The headset 100 can optionally include a wireless connection port 16 for coupling to a wireless module or antenna (e.g., a BLUETOOTH® USB device), so as to allow the headset 100 to wirelessly communicate with, for example, a video game console, a music player, a video player, etc. The headset 100 can optionally include circuitry and controls 70 for controlling the operation of the headset 100, as further described below.

With reference to FIG. 3, the headset 100 can optionally include a microphone boom 20 that can extend between a distal microphone diaphragm or input 22 and a connector 24 that connects to the connection port 12 of the arm 3*a*. The connector 24 can movably connect to the connection port 12 so that the boom 20 can be rotated relative to the arm 3*a*, as shown by arrow N in FIG. 3. Only a portion of the arm 3*a* is shown in FIG. 3, and the speaker 10*a* and support portion 2 are excluded from FIG. 3.

Figure 4A:
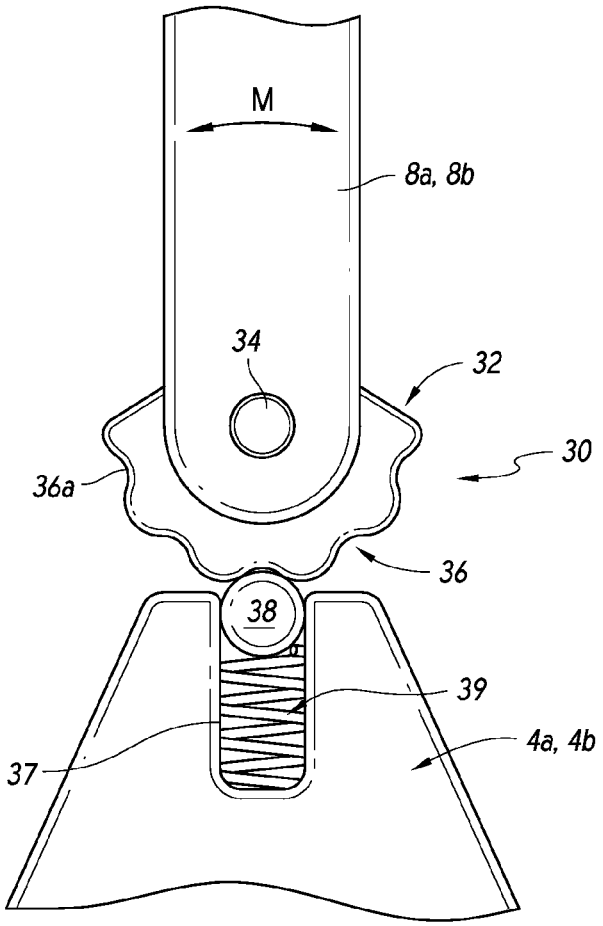
FIG. 4A is a schematic view of one embodiment of a pivoting mechanism for an adjustable headset or headphones.

FIG. 4A shows one embodiment of a pivoting mechanism 30 for an adjustable headset or headphones, such as the adjustable headset 100 shown in FIGS. 1-3. In one embodiment, the pivoting mechanism 30 can be incorporated into each of the arms 3*a*, 3*b* to movably couple the bridge portion 4*a*, 4*b* with the second arm portion 8*a*, 8*b*. In another embodiment, the pivoting mechanism 30 and additionally, or alternatively, couple the first arm portions 6*a*, 6*b* and the second arm portions 8*a*, 8*b*. The pivoting mechanism 30 can include a detent mechanism with a female member 32 attached (e.g., fixedly attached) to the second arm portion 8*a*, 8*b* via a fastener 34 (e.g., pin, shaft, axle, screw, bolt, etc.). In one embodiment, the fastener 34 (e.g., pin, shaft axle) also movably couples the first arm portion 6*a*, 6*b* with the second arm portion 8*a*, 8*b*. In one embodiment, the female member 32 can be generally circular or shaped like a wheel. In another embodiment, the female member can be semi-circular. The female member 32 can have one or more depressions, undulations or recesses 36 on an outer engaging surface or edge 36*a* thereof. In the illustrated embodiment, the female member 32 has multiple depressions, undulations or recesses 36. However, in other embodiments, the female member 32 can have two depressions, undulations or recesses 36. The pivoting mechanism 30 can include a ball or pin 38 disposed in a recessed cavity 37 defined in the bridge portion 4*a*, 4*b*. A resilient member 39 (e.g., a spring) can be disposed in the recessed cavity 37 and can apply a resilient force (e.g., spring force) on the pin 38 to urge the pin 38 into engagement with one of the one or more depressions, undulations or recesses 36. Optionally, the ball or pin 38 can have a generally spherical shape. Optionally, the one or more depressions, undulations or recesses 36 are sized to removably capture the pin 38 therein so as to provide a generally stable and fixed angular orientation between the bridge portion 4*a*, 4*b* and the second arm portion 8*a*, 8*b*. Optionally, a user can manually actuate the second arm portion 8*a*, 8*b* to pivot it about the fastener 34 (along arrow M) so as to force the pin 38 out of one of the depressions 36 and into another of the depressions 36, thereby changing the angular orientation between the second arm portion 8*a*, 8*b* and the bridge portion 4*a*, 4*b* and first arm portion 6*a*, 6*b* to a different generally stable and fixed angular orientation. Advantageously, the force applied by the resilient member 39 on the pin 38 can maintain the pin 38 within one of the depressions 36 so as to maintain the angular orientation of the second arm portion 8*a*, 8*b* relative to the first arm portion 6*a*, 6*b*, once changed, without being supported by the user (i.e., without the user holding onto the second arm portion 8*a*, 8*b*).

In another embodiment, the female member 32 can be attached to the bridge portion 4*a*, 4*b* and the resilient member 39 can be disposed in a recessed cavity in the second arm portion 8*a*, 8*b*. In another embodiment, the female member 32 can be attached to the first arm portion 6*a*, 6*b* and the resilient member 39 can be disposed in a recessed cavity in the second arm portion 8*a*, 8*b*. In another embodiment, the female member 32 can be attached to the second arm portion 8*a*, 8*b* and the resilient member 39 can be disposed in a recessed cavity in the first arm portion 6*a*, 6*b*.

Figure 4B:
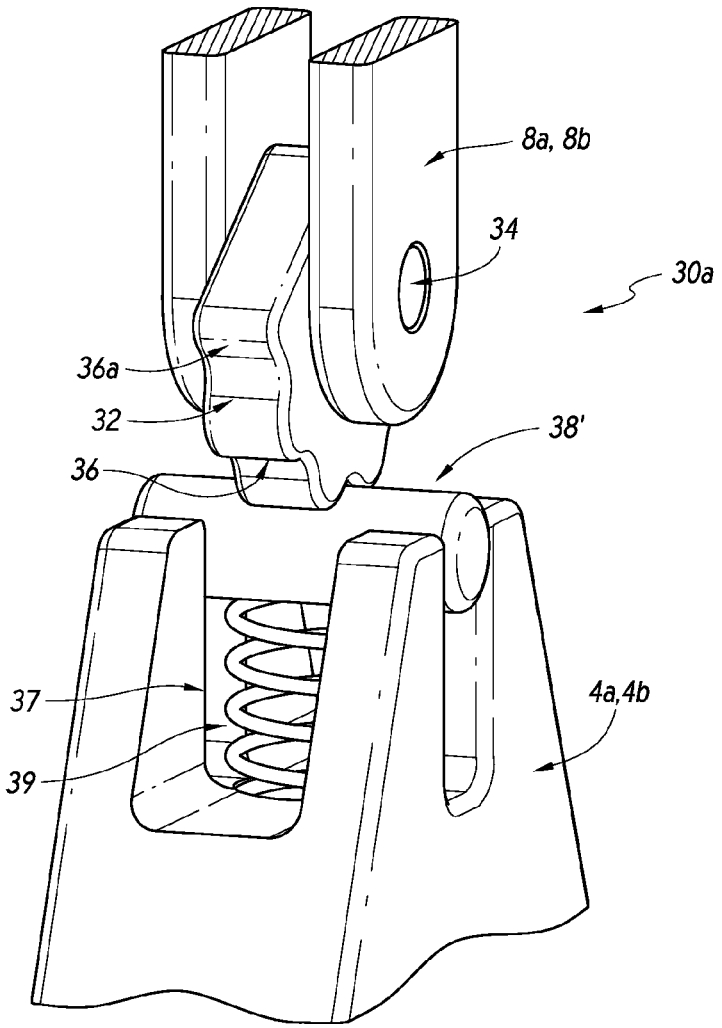
FIG. 4B is a schematic view of another embodiment of a pivoting mechanism for an adjustable headset or headphones.

FIG. 4B shows another embodiment of a pivoting mechanism 30*a* for an adjustable headset or headphones, such as the adjustable headset 100 shown in FIGS. 1-3. The pivoting mechanism 30*a* is identical to the pivoting mechanism 30, except as described below. Accordingly, similar components in the pivoting mechanism 30*a* have the same numerical identifier as the corresponding component in the pivoting mechanism 30 of FIG. 4A. The pivoting mechanism 30*a* includes a rod 38' that extends between flanges of bridge portion 4*a*, 4*b*, where the rod 38' is sized to at least partially fit into the one or more depressions 36 of the female member 32. Optionally, the rod 38' can have a circular cross-section and the one or more depressions 36 can have a generally curved shape. Similar to the description of the pivoting mechanism 30, the resilient member 39 can apply a resilient force (e.g., spring force) on the rod 38' to urge the rod 38' into engagement with one of the one or more depressions 36. In another embodiment, the female member 32 can be attached to the bridge portion 4*a*, 4*b* and the resilient member 39 can be disposed in a recessed cavity in the second arm portion 8*a*, 8*b*. In another embodiment, the female member 32 can be attached to the first arm portion 6*a*, 6*b* and the resilient member 39 can be disposed in a recessed cavity in the second arm portion 8*a*, 8*b*. In another embodiment, the female member 32 can be attached to the second arm portion 8*a*, 8*b* and the resilient member 39 can be disposed in a recessed cavity in the first arm portion 6*a*, 6*b*.

Figure 4C:
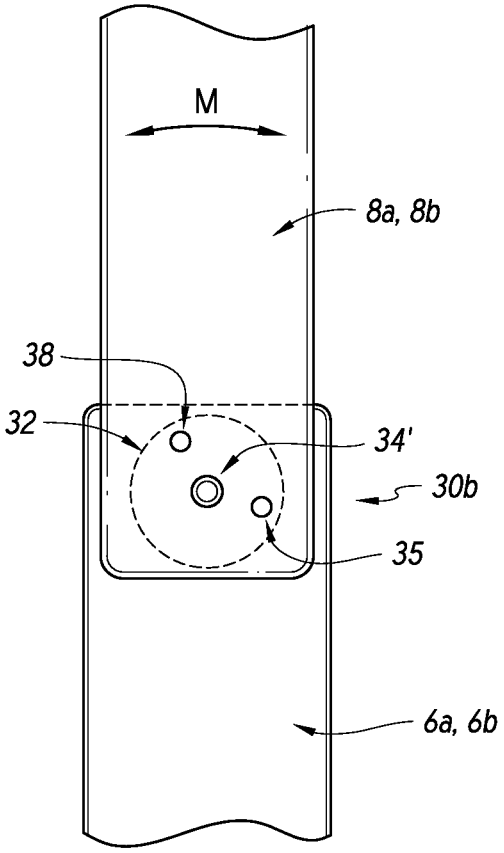
FIG. 4C is a schematic view of another embodiment of a pivoting mechanism for an adjustable headset or headphones.

FIG. 4C shows another embodiment of a pivoting mechanism 30*b* for an adjustable headset or headphones, such as the adjustable headset 100 shown in FIGS. 1-3. The pivoting mechanism 30*b* is similar to the pivoting mechanism 30, except as described below. Accordingly, similar components in the pivoting mechanism 30*b* have the same numerical identifier as the corresponding component in the pivoting mechanism 30 of FIG. 4A. The pivoting mechanism 30*b* can be a ratchet mechanism between the first arm portion 6*a*, 6*b* and the second arm portion 8*a*, 8*b*. The pivoting mechanism 30*b* can include a gear or first ratchet member 32 attached to one of the first arm portion 6*a*, 6*b* and second arm portion 8*a*, 8*b* and an axle, shaft or pin 34' that movably interconnects the first arm portion 6*a*, 6*b* to the second arm portion 8*a*, 8*b*. The pivoting mechanism 30*b* can include a pin, pawl, catch member or second ratchet member 38 that can releasably engage one or more of the teeth of the gear or first ratchet member 32 to effect an angular orientation between the first arm portion 6*a*, 6*b* and the second arm portion 8*a*, 8*b*. In one embodiment, the pin, pawl, catch or second ratchet member 38 can releasably engage one or more of the teeth of the gear or first ratchet member 32 via actuation (e.g., manual actuation, such as pivoting or rotating) by the user of the second arm portion 8*a*, 8*b*. Optionally, the pin, pawl, catch or second ratchet member 38 can be spring loaded to allow it to automatically engage the one or more teeth of the gear or first ratchet member 32 as the second arm portion 8*a*, 8*b* is pivoted (e.g., manually by a user) relative to the first arm portion 6*a*, 6*b*. Once the user stops pivoting the second arm portion 8*a*, 8*b*, the pivoting mechanism 30*b* can maintain said angular orientation via the interaction of the pin, pawl or second ratchet member 38 with the gear member 32. Optionally, the pivoting mechanism 30*b* can include a release member 35, which can be a lever, button or other actuator, the release member 35 actuatable to release the pin, pawl, catch or second ratchet member 38 from engagement with the gear member 32, thereby allowing the second arm portion 8*a*, 8*b* to be pivoted back (e.g., automatically, or manually by the user) to the home or retracted position. In another embodiment, the release member 35 can be excluded. In another embodiment, the pivoting mechanism 30*b* can be a ball and socket joint, where the ball member can be the second ratchet member 38 and the socket can be the first ratchet member 32. In this embodiment, the ball member can releasably engage the socket in several different angular orientations to allow the second arm portion 8*a*, 8*b* to be pivoted so several stable angular orientations relative to the first arm portion 6*a*, 6*b*.

Figure 5:
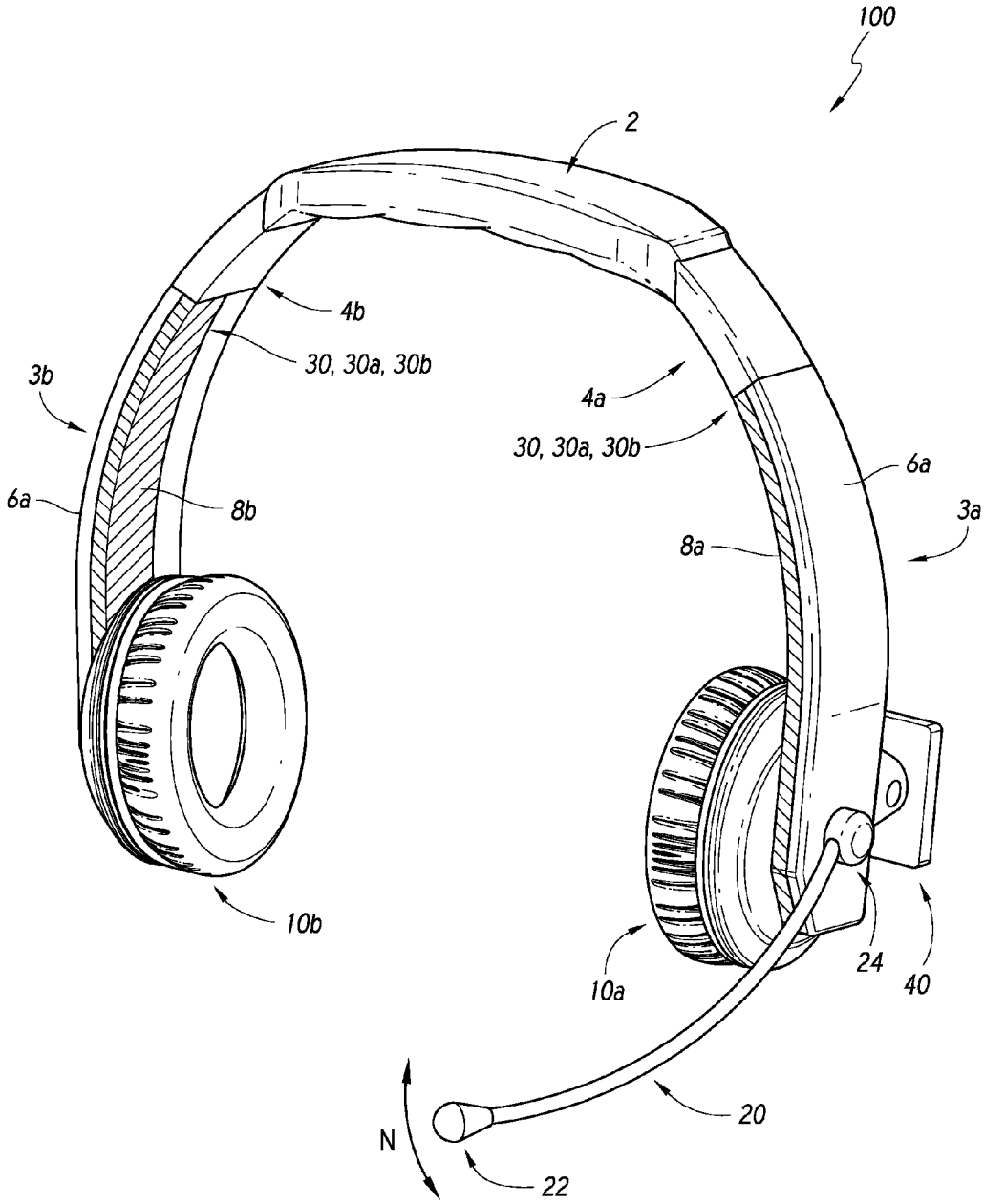
FIG. 5 is a perspective front view of the adjustable headset or headphones of FIG. 1 having a microphone boom attached to one of the arms of the headset and showing the speakers in a first orientation relative to the top end of the headset.
Figure 6:
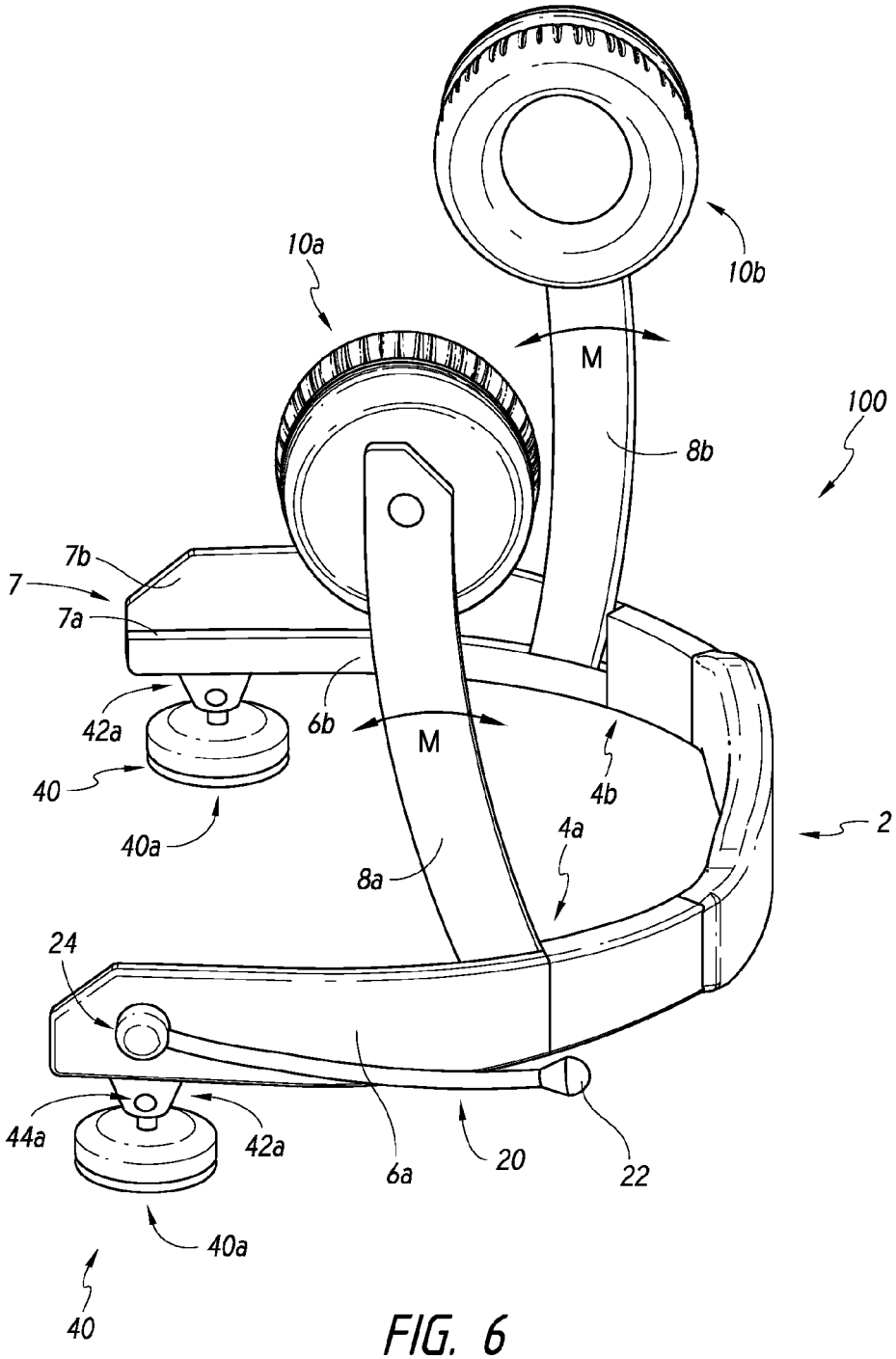
FIG. 6 is a perspective side view of the adjustable headset of headphones of FIG. 5, showing the speakers in a second orientation (different than the first orientation) relative to the top end of the headset.
Figure 7:
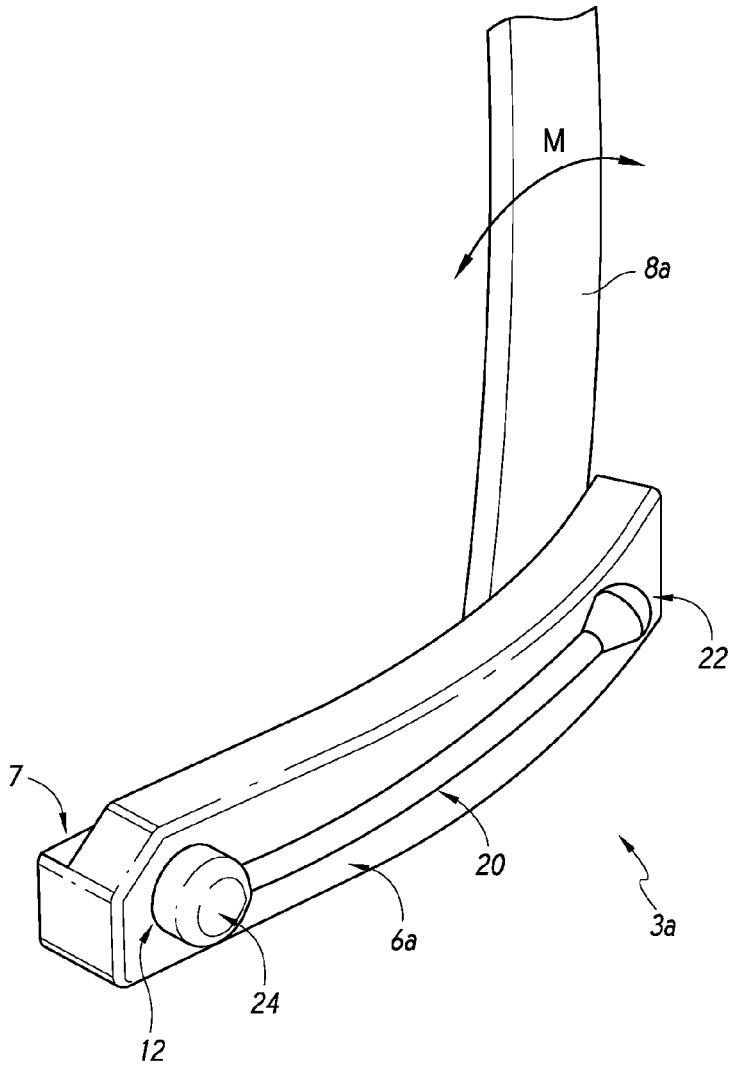
FIG. 7 shows a perspective side view of one arm of the headset of FIG. 5, showing a first arm portion pivoted relative to a second arm portion.

FIGS. 5-7 illustrate further features of an adjustable headset or headphones, such as the headset 100. As shown in FIG. 5 and previously discussed, the microphone boom 20 can be pivoted relative to the arm 3*a* (see arrow N), to allow the user to change the position of the microphone diaphragm or input 22 relative to the user. The headset 100 can optionally include a support member 40 coupled to the rear of the arms 3*a*, 3*b* to facilitate support of the headset 100 on the user when worn around the user's neck so that the rear side of the arms 3*a*, 3*b* faces the shoulders or chest area of the user. The support member 40 can include a support element 40*a*, which can include a soft or compressible material (e.g., foam). The support element 40*a* can be coupled (e.g., movably coupled) to a connector 42*a* attached to the rear side of the arms 3*a*, 3*b* via a fastener 44*a* (e.g., pin).

In some embodiments, the support member 40 can be excluded from the headset 100. In still another embodiment, an edge of the first arm portions 6*a*, 6*b* that faces the user when the headset 100 is worn around the user's neck, can optionally have a contoured (e.g., curved) shape, allowing the headset 100 to be comfortably and stably supported on the user's upper chest area. One of skill in the art that other headset embodiments disclosed herein, such as the headset 200, 300, 400, 500 can optionally have similar features.

FIGS. 6-7 show the second arm portions 8*a*, 8*b* in a deployed position relative to the first arm portions 6*a*, 6*b*, so that the headset 100 can be positioned about the user's neck and so the support portion 2 at least partially rests on the users neck and shoulders while the first arm portions 6*a*, 6*b* at least partially rest on the user's shoulders and/or upper chest area. The speakers 10*a*, 10*b* can be pivoted (via the pivoting mechanism 30, 30*a*, 30*b*) to adjust the position of the speakers 10*a*, 10*b* relative to the user's ears in order to direct the sound from the speakers 10*a*, 10*b* toward the user's ears while allowing the user to hear ambient sounds (e.g., from other people in the same room, the phone ringing, the doorbell ring).

Figure 8:
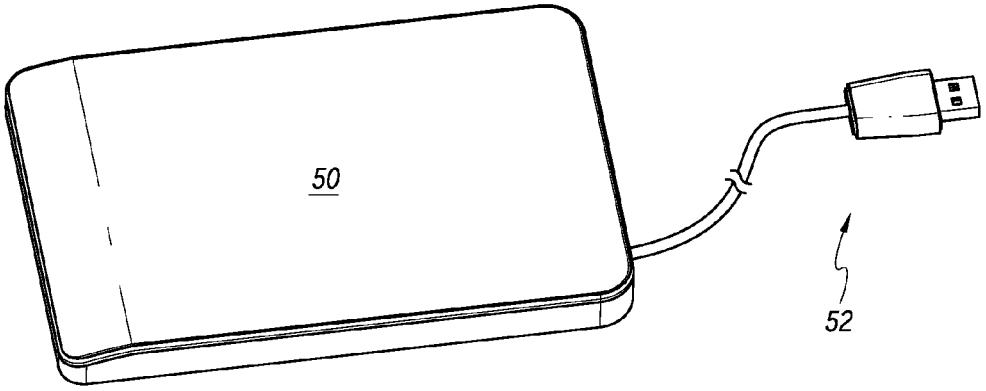
FIG. 8 is a schematic view of a battery for use with the adjustable headset or headphones.

With reference to FIG. 8, the headset 100 can optionally include one or more batteries 50. In one embodiment, the one or more batteries 50 can be removably housed in one of the arms 3*a*, 3*b* or the support portion 2. The one or more batteries 50 can optionally be rechargeable batteries, such as lithium ion batteries. However, in other embodiments, the one or more batteries 50 need not be rechargeable. In still other embodiments, batteries can be excluded from the headset 100 and a direct electrical connection provided (e.g., to an electrical outlet or via an electrical connection to the video game console, music player, video player, etc.).

Figure 9:
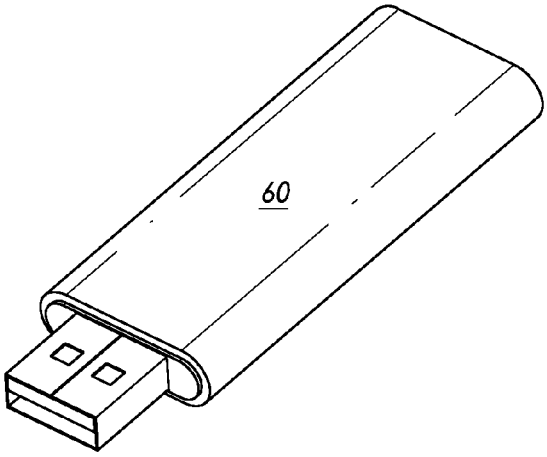
FIG. 9 is a schematic view of a wireless (e.g., Bluetooth) adapter for use with the adjustable headset or headphones.

With reference to FIG. 9, the headset 100 can optionally include a wireless communication device (e.g., transmitter, receiver or transceiver, such as a BLUETOOTH® USB device) 60, which can connect to the connection port 16 on the headset 100. The wireless communication device 60 can allow the user to transmit information (e.g., sound input via the microphone) wirelessly, for example, to the video game console to communicate with other users. The wireless communication device 60 can also allow the user to receive information (e.g., sound, comments from other gamers playing the same interactive video game) wirelessly, for example, from the video game console.

Figure 10:
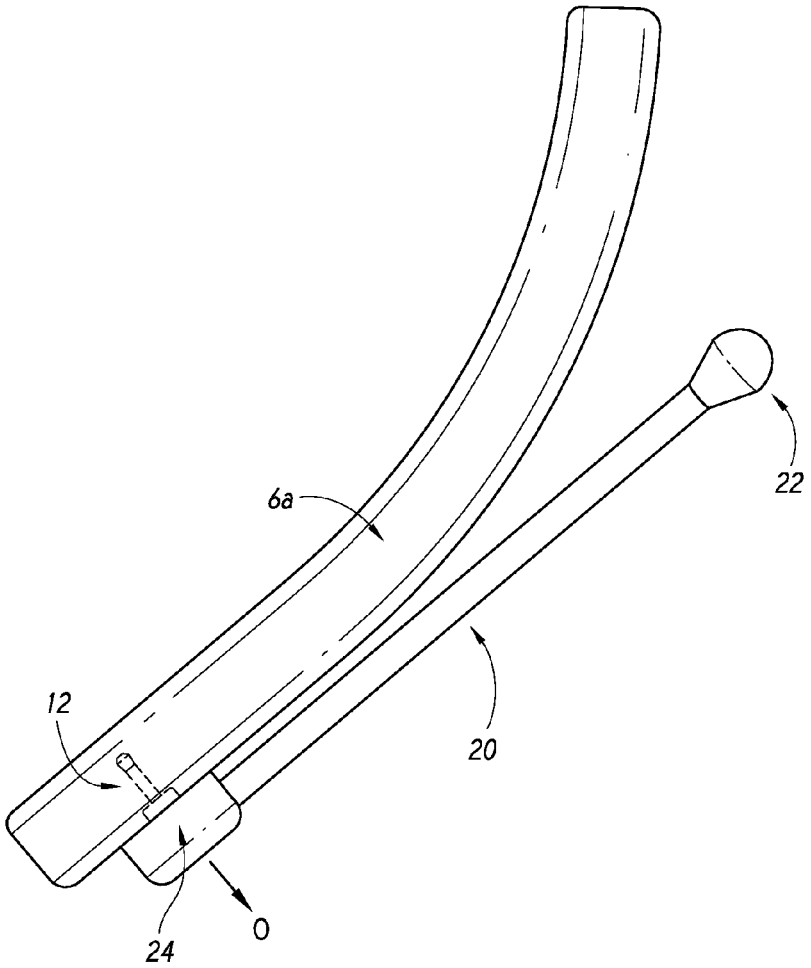
FIG. 10 is a schematic front view of a portion of an arm of the adjustable headset or headphones, showing the connection of the microphone boom to the arm.

With reference to FIG. 10, the microphone boom 20 can be removably coupled to the first arm portion 6*a* of the headset 100 via a connector 24 that is removably insertable into the microphone port 12 on the first arm portion 6*a*. The microphone boom 20 can be decoupled from the first arm portion 6*a* by moving the connector 24 out of the port 12 (along arrow O).

Figure 11:
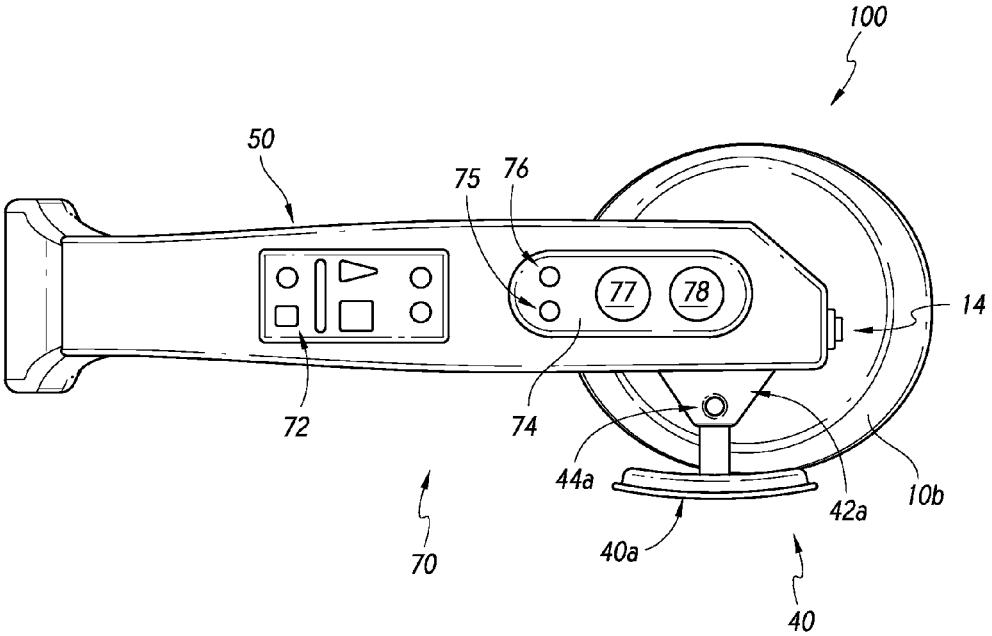
FIG. 11 is a schematic side view of the adjustable headset or headphones of FIG. 5, showing electronics and controls associated with the headphones.

With reference to FIG. 11, the headset 100 can optionally include circuitry and controls 70 for controlling the operation of the headset 100. The circuitry and controls 70 can optionally include an amplified circuit board 72, a control board 74, a mute button 75, a stereo or mono selector 76, a microphone volume control 77, and/or a master volume control 78. In one embodiment, the one or more batteries 50 can be removably disposed behind the circuit board 72 (e.g., within a compartment of the arm 3*b*).

In one embodiment, the second arm portion 8*a*, 8*b* can extend generally parallel to the first arm portion 6*a*, 6*b* while the second arm portion 8*a*, 8*b* is in a refracted position, but along a non-parallel plane when the second arm portion 8*a*, 8*b* is in a deployed or extended position (e.g., so the speakers pivot outward as they are adjusted toward the user's ears when the headset 100 is worn around the neck so that it's supported on the user's shoulders and/or chest). In another embodiment, the second arm portion 8*a*, 8*b* can extend generally parallel to the first arm portion 6*a*, 6*b* while the second arm portion 8*a*, 8*b* is in a retracted position and in an extended position.

In use, the user can wear the headset 100 on their head like other headphones and can adjust the arms 3*a*, 3*b* relative to the bridge portions 4*a*, 4*b* to adjust the fit of the headset 100 to the user's head. In embodiments where the microphone boom 20 is coupled to the headset 100, the user can also adjust the location of the microphone boom 20, as described above, to locate the input 22 proximate the user's mouth. The user can then take part in online video gaming utilizing the headset 100 and can use the controls 70 to control the operation of the headset (e.g., volume level, stereo or mono selector). If the user plans on participating in an online gaming session for an extended period of time (e.g., 2 hours, 4 hours, 6 hours), the user can wear the headset 100 around their neck so that the support portion 2 rests on the back of the user's neck and/or shoulders, and so the first arm portions 6*a*, 6*b* rest on the user's shoulders and/or upper chest area. The user can move (e.g., pivot) the second arm portions 8*a*, 8*b* relative to the first arm portions 6*a*, 6*b* to position the speakers 10*a*, 10*b* proximate the user's ears to provide an improved sound experience while inhibiting ear fatigue and discomfort from prolonged use of the headset 100. The user can move (e.g., pivot) the second arm portions 8*a*, 8*b* relative to the first arm portions 6*a*, 6*b* to one or more (e.g., multiple) generally fixed positions provided by the pivoting mechanism 30, 30*a*, 30*b*, as discussed above. For example, the user can optionally move (e.g., pivot) the second arm portions 8*a*, 8*b* relative to the first arm portions 6*a*, 6*b* so that the second arm portions 8*a*, 8*b* are oriented at a generally perpendicular angle relative to the first arm portions 6*a*, 6*b*. In another example, the user can optionally (or additionally) move (e.g., pivot) the second arm portions 8*a*, 8*b* relative to the first arm portions 6*a*, 6*b* so that the second arm portions 8*a*, 8*b* are oriented at a generally obtuse angle relative to the first arm portions 6*a*, 6*b*. In still another example, the user can optionally (or additionally) move (e.g., pivot) the second arm portions 8*a*, 8*b* relative to the first arm portions 6*a*, 6*b* so that the second arm portions 8*a*, 8*b* are oriented at a generally acute angle relative to the first arm portions 6*a*, 6*b*. One of skill in the art will recognize that although the use of the headset above is described in connection with video gaming applications, the headset 100 is not limited for use to video gaming, but can be used in other suitable applications (e.g., listening to music, for receiving audio from a video player, for use with a personal or laptop computer).

Figure 12:
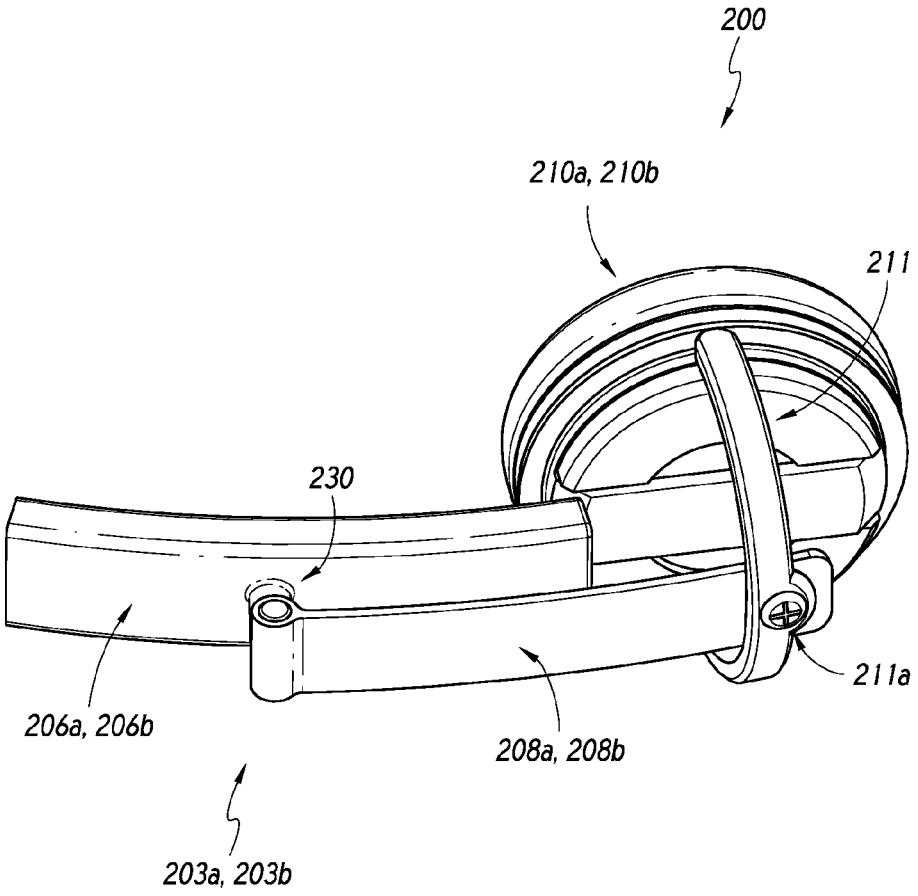
FIG. 12 is a schematic side view of a portion of another embodiment of an adjustable headset or headphones.

FIG. 12 shows another embodiment of an adjustable headset or headphones 200. The adjustable headset 200 is similar to the adjustable headset 100, except as described below. For simplicity, only a portion of the headset 200 is illustrated in FIG. 12. The headset 200 can have a pair of arms 203*a*, 203*b*. Each of the arms 203*a*, 203*b* can have a first arm portion 206*a*, 206*b* and a second arm portion 208*a*, 208*b*. The second arm portion 208*a*, 208*b* can be pivoted relative to the first arm portion 206*a*, 206*b* via a pivoting mechanism 230 to one or more generally stable and fixed angular orientations so as to change the position of the speakers 210*a*, 210*b* relative to the user's ears when the headset 200 is worn around the user's neck so that it at least partially rests on the user's shoulders and upper chest portion. The speakers 210*a*, 210*b* can be coupled to the second arm portions 208*a*, 208*b* via a connector 211 attached to the second arm portions 208*a*, 208*b* with one or more fasteners 211*a*. The pivoting mechanism 230 can be similar to the pivoting mechanisms 30, 30*a*, 30*b* described above. In the illustrated embodiment, the second arm portion 208*a*, 208*b* is an outer arm portion and the first arm portion 206*a*, 206*b* is an inner arm portion, so that the second arm portion 208*a*, 208*b* extends along a plane outward from (e.g., radially outward from) the first arm portion 206*a*, 206*b*.

In one embodiment, the second arm portion 208*a*, 208*b* can extend generally parallel to the first arm portion 206*a*, 206*b* while the second arm portion 208*a*, 208*b* is in a retracted position, but along a non-parallel plane when the second arm portion 208*a*, 208*b* is in a deployed or extended position (e.g., so the speakers pivot outward as they are adjusted toward the user's ears when the headset 200 is worn around the neck so that it's supported on the user's shoulders and/or chest). In another embodiment, the second arm portion 208*a*, 208*b* can extend generally parallel to the first arm portion 206*a*, 206*b* while the second arm portion 208*a*, 208*b* is in a retracted position and in an extended position. One of skill in the art will recognize that other embodiments of the headset described herein, such as the headset 100, 300, 400, 500, can optionally operate in the same manner.

In use, the user can wear the headset 200 on their head like other headphones and can adjust the arms 203*a*, 203*b* relative to the bridge portions (not shown but similar to bridge portions 4*a*, 4*b*) to adjust the fit of the headset 200 to the user's head. In embodiments where a microphone boom (such as the microphone boom 20) is coupled to the headset 200, the user can also adjust the location of the microphone boom, as described above, to locate the input proximate the user's mouth. The user can then take part in online video gaming utilizing the headset 200 and can use the controls (not shown but can be similar to controls 70) to control the operation of the headset (e.g., volume level, stereo or mono selector). If the user plans on participating in an online gaming session for an extended period of time (e.g., 2 hours, 4 hours, 6 hours), the user can wear the headset 200 around their neck so that the support portion (not shown but can be similar to support portion 2) rests on the back of the user's neck and/or shoulders, and so the first arm portions 206*a*, 206*b* rest on the user's shoulders and/or upper chest area. The user can move (e.g., pivot) the second arm portions 208*a*, 208*b* relative to the first arm portions 206*a*, 206*b* to position the speakers 210*a*, 210*b* proximate the user's ears to provide an improved sound experience while inhibiting ear fatigue and discomfort from prolonged use of the headset 200. The user can move (e.g., pivot) the second arm portions 208*a*, 208*b* relative to the first arm portions 206*a*, 206*b* to one or more (e.g., multiple) generally fixed positions provided by the pivoting mechanism 230, as discussed above. For example, the user can optionally move (e.g., pivot) the second arm portions 208*a*, 208*b* relative to the first arm portions 206*a*, 206*b* so that the second arm portions 208*a*, 208*b* are oriented at a generally perpendicular angle relative to the first arm portions 206*a*, 206*b*. In another example, the user can optionally (or additionally) move (e.g., pivot) the second arm portions 208*a*, 208*b* relative to the first arm portions 206*a*, 206*b* so that the second arm portions 208*a*, 208*b* are oriented at a generally obtuse angle relative to the first arm portions 206*a*, 206*b*. In still another example, the user can optionally (or additionally) move (e.g., pivot) the second arm portions 208*a*, 208*b* relative to the first arm portions 206*a*, 206*b* so that the second arm portions 208*a*, 208*b* are oriented at a generally acute angle relative to the first arm portions 206*a*, 206*b*. One of skill in the art will recognize that although the use of the headset above is described in connection with video gaming applications, the headset 200 is not limited for use to video gaming, but can be used in other suitable applications (e.g., listening to music, for receiving audio from a video player, for use with a personal or laptop computer).

Figures 13A, 13B:
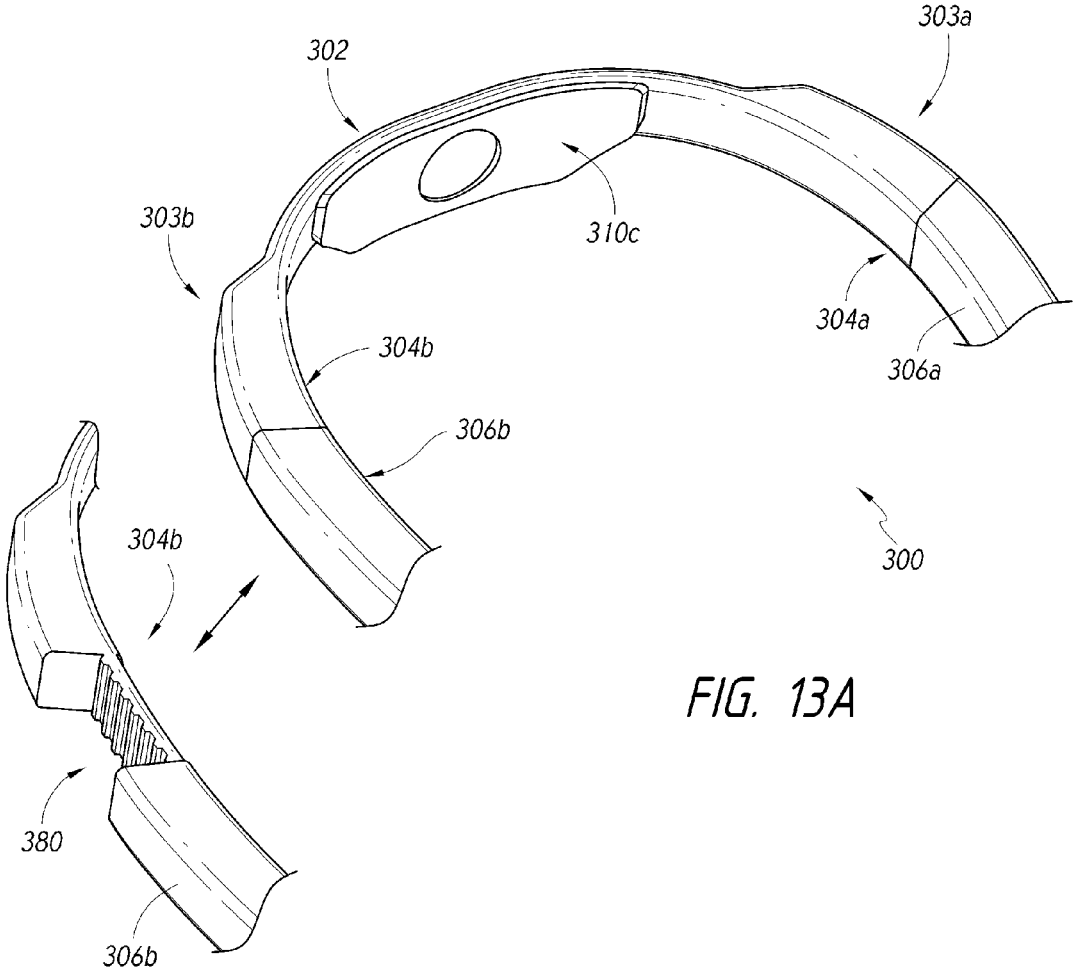
FIG. 13A is a schematic perspective front view of a portion of another embodiment of an adjustable headset or headphones, showing the first arm portions in a first position relative to a second arm portions.
FIG. 13B is a schematic perspective front view of a portion of the adjustable headset or headphones of FIG. 13A, showing the first arm portion in a second position relative to a second arm portion.
Figure 14:
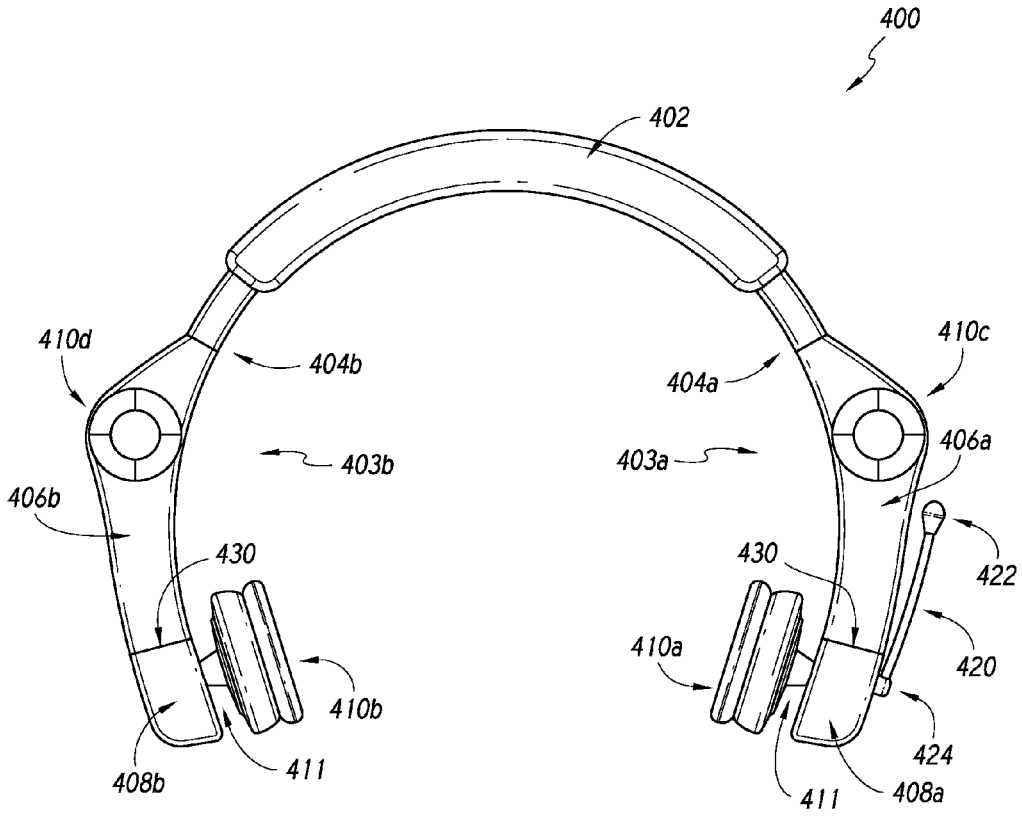
FIG. 14 is a schematic front view of another embodiment an adjustable headset or headphones.
Figure 15:
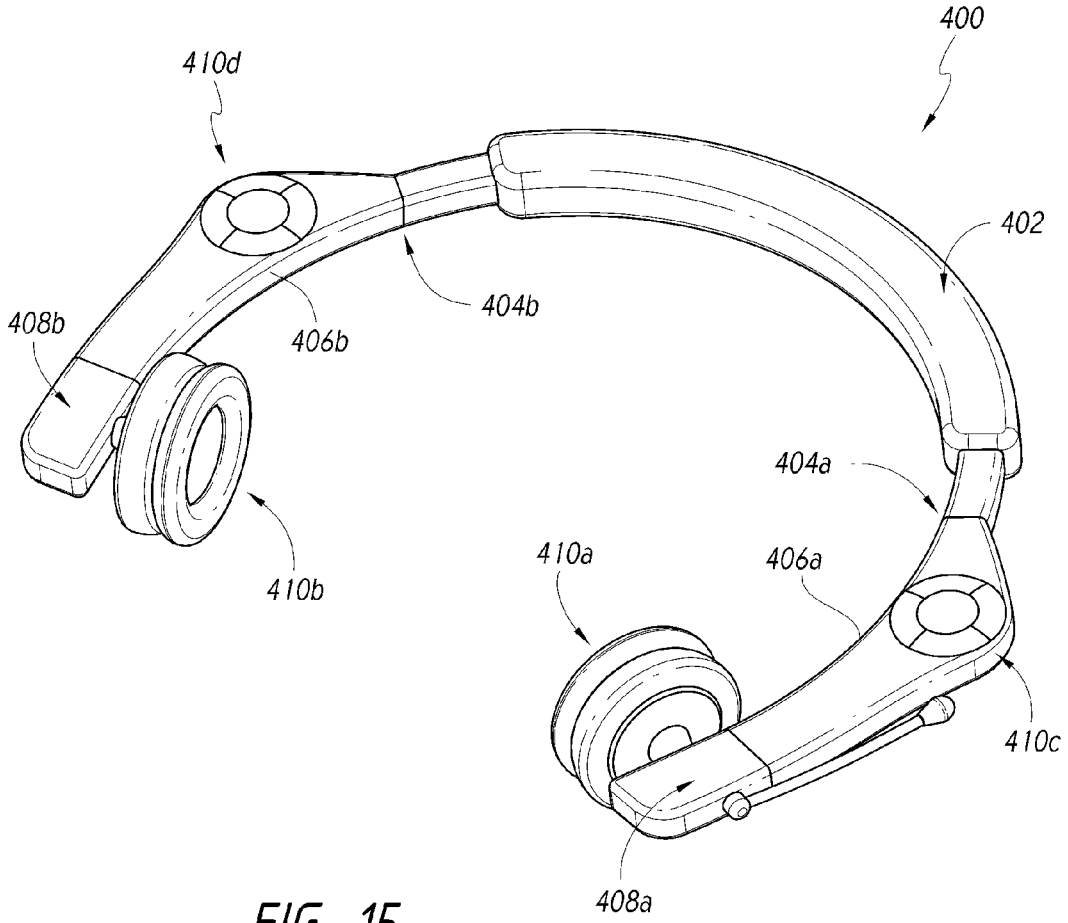
FIG. 15 is a schematic perspective front view of the adjustable headset of FIG. 14.
Figure 16:
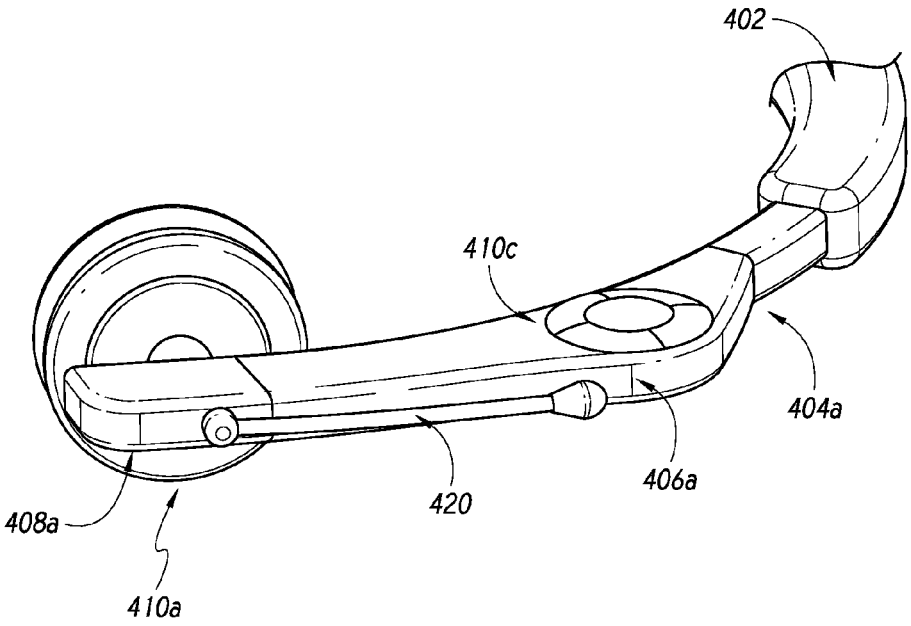
FIG. 16 is a schematic perspective front view of a portion of the adjustable headset of FIG. 14, with the headphone speakers in a first orientation.
Figure 17:
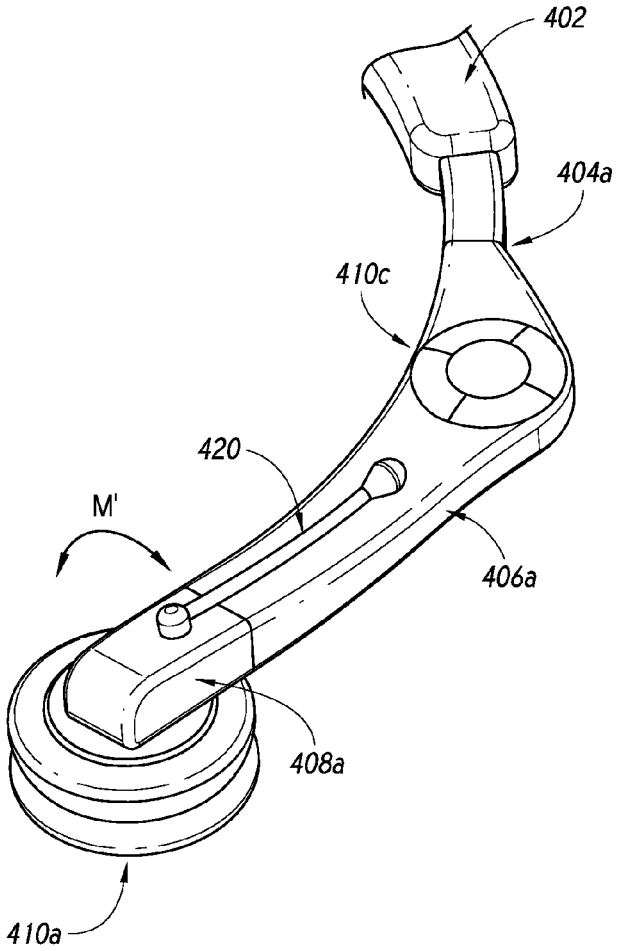
FIG. 17 is a schematic perspective front view of a portion of the adjustable headset of FIG. 14, with the headphone speakers in a second orientation.
Figure 18:
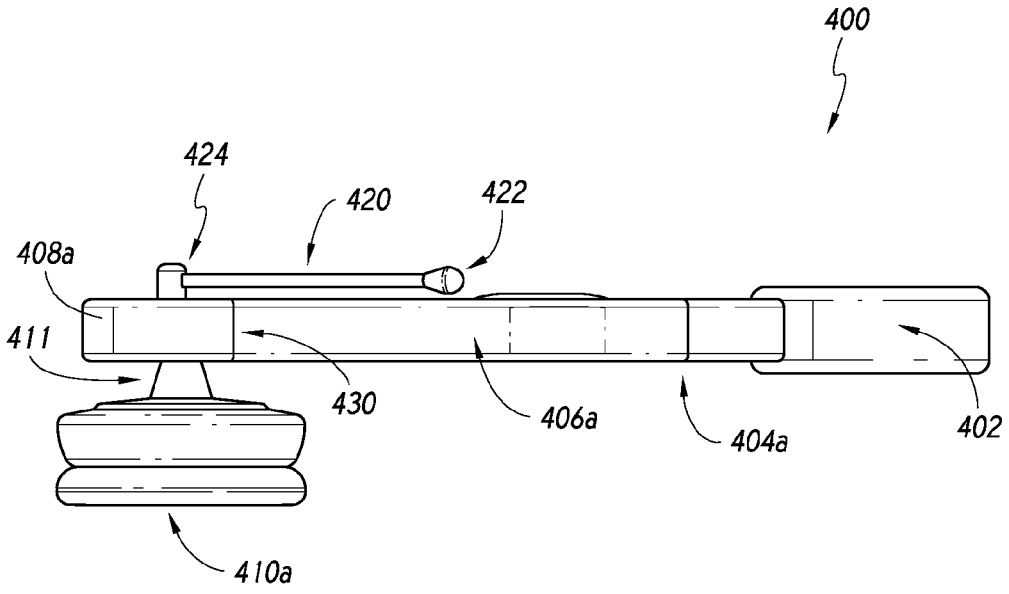
FIG. 18 is a schematic side view of the adjustable headset of FIG. 14, showing the headphone speakers in the second orientation.

FIGS. 13A-13B show a portion of another embodiment of an adjustable headset or headphones 300. The headset 300 is similar to the headset 100, except as described below. The headset 300 can have a support portion 302 that can be positioned on top of the user's head when the headset 300 is worn on the head, or on the back of the user's neck when the headset 300 is worn around the user's neck so that at least a portion of the arms 303*a*, 303*b* are supported on the user's shoulders and/or upper chest area. The support portion can optionally be contoured to better fit over the user's head and/or around the user's neck. The headset 300 can have a speaker 310C attached to, coupled to, or otherwise carried by the support portion 302. In one embodiment, the speaker 310C can be a subwoofer. In one embodiment, the speaker 310*c* can optionally be actuated only when the headset 300 is worn around the user's neck. For example, the headset 300 can include a gyro, accelerometer or other sensor that can measure the angular orientation, inclination or tilt of the support portion 302, for example relative to the arms 303*a*, 303*b* and/or the speakers attached to the arms 303*a*, 303*b* of the headset 300. In another embodiment, the speaker 310*c* can be manually actuated by the user via a switch on the controls (such as the controls 70 in the headset 100). In still another embodiment, the speaker 310*c* can optionally be turned on (e.g., via an electronic switch) when the speakers are pivoted toward the user's ears when the headset 300 is worn around the user's neck, as discussed below, where said pivoting mechanism actuates a switch to turn the speaker on or off, depending on whether the speakers are being pivoted toward an extended position proximate the user's ears or toward the retracted position. Said speakers and arm portions (e.g., first arm portion, second arm portion) of the headset 300 are not shown in FIGS. 13A-13B, but in one embodiment can have the same structure as the first arm portion 6*a*, 6*b*, second arm portion 8*a*, 8*b* and speakers 10*a*, 10*b* of the headset 100. In another embodiment, said speakers and arm portions (e.g., first arm portion, second arm portion) of the headset 300 can have the same structure as the first arm portion 206*a*, 206*b*, second arm portion 208*a*, 208*b* and speakers 210*a*, 210*b* of the headset 200.

In one embodiment, actuating a pivoting mechanism of the headset 300 (such as the pivoting mechanism 30, 30*a*, 30*b* or 230 used in the headset 100 or 200) to move the second arm portions to a second extended position can actuate a switch (not shown) to allow sound to be output via the speaker 310C. Optionally, actuating the pivoting mechanism to move the second arm portions to the second extended position can actuate a switch (not shown) to disallow sound from being output via the speakers attached to the arms 303*a*, 303*b*. Optionally, actuating the pivoting mechanism to move the second arm portions to a first retracted position can actuate a switch (not shown) to allow sound to be output via the speakers attached to the arms 303*a*, 303*b*. Optionally, actuating the pivoting mechanism to move the second arm portions to the first retracted position can actuate a switch (not shown) to disallow sound from being output via the speaker 310*c*.

With continued reference to FIGS. 13A-13B, the arms 303*a*, 303*b* can include a connecting bridge portion 304*a*, 304*b* that movably (e.g., slidably) couples to the first arm portion 306*a*, 306*b*. The bridge portion 304*a*, 304*b* can include a connector 380 (e.g., track) that connects to the first arm portion 306*a*, 306*b* and allows the first arm portion 306*a*, 306*b* to be extended relative to the support portion 302 to adjust the distance between the support portion 302 and the speakers (not shown) attached to the arms 303*a*, 303*b*, thereby allowing the headset 300 to be adjusted to accommodate a variety of user head sizes and shapes. The support portion 302 can optionally be contoured to better fit over the user's head and/or around the user's neck.

FIGS. 14-18 show another embodiment of a headset or headphones 400. The headset 400 can have a support portion 402 for supporting the headset 400 on the user's head when worn in a generally upright orientation by the user. The headset 400 can have a pair of arms 403*a*, 403*b* attached to the support portion 402. The support portion 402 can optionally be contoured to better fit over the user's head and/or around the user's neck. Optionally, the arms 403*a*, 403*b* can be movably (e.g., slidably) coupled to the support portion 402 via bridge portions 404*a*, 404*b* that allow the arms 403*a*, 403*b* to be extended relative to the support portion 402, thereby allowing the distance between the support portion 402 and speakers 410*a*, 410*b* to be adjusted to accommodate a variety of user head sizes and shapes. Optionally, the bridge portions 404*a*, 404*b* can be similar to the bridge portions 304*a*, 304*b* and have a connector (not shown), similar to the connector 380, that connects with the arms 403*a*, 403*b*.

The arms 403*a*, 403*b* can include first arm portions 406*a*, 406*b* and second arm portions 408*a*, 408*b*, where a proximal end of the first arm portions 406*a*, 406*b* are proximate (e.g., adjacent) the bridge portions 404*a*, 404*b*, and wherein a distal end of the first arm portions 406*a*, 406*b* are proximate (e.g., adjacent) the second arm portions 408*a*, 408*b*. The speakers 410*a*, 410*b* can be coupled to the second arm portions 408*a*, 408*b* via a connector 411. Optionally, the connector 411 allows the speakers 410*a*, 410*b* to swivel relative to the second arm portions 408*a*, 408*b*.

The headset 400 can also include a microphone boom 420 that extends between a diaphragm or input end 422 and a connector 424. Optionally, the microphone boom 420 can be removably coupled to the headset 400 via a microphone port (not shown), which can be similar to the microphone port 12 of the headset 100. The microphone boom 420 can be pivoted or moved relative to the arm 403*a* in the manner discussed above for other headset embodiments, and can have the same background noise filtering characteristics.

The headset 400 can include a pivoting or swivel mechanism 430 that allows the second arm portions 408*a*, 408*b* to pivot or swivel relative to the first arm portions 406*a*, 406*b* to change the orientation of the speakers 410*a*, 410*b* relative to the first arm portions 406*a*, 406*b*. In one embodiment, the second arm portions 408*a*, 408*b* can be pivoted between a first position where the speakers 410*a*, 410*b* are oriented inwardly toward the user's ears (see FIG. 14) when the headset 400 is worn on the user's head and a second position where the speakers 410*a*, 410*b* are oriented downwardly toward the user's chest area (see FIG. 18) when the headset 400 is worn around the user's neck so that the arms 403*a*, 403*b* rest on the user's shoulders and/or upper chest area. When pivoted into the second position, the speakers 410*a*, 410*b* can function as support members (similar to the support members 40 of the headset 100) to facilitate support of the headset 400 on the user when worn around the user's neck so that the headset 400 is maintained in a generally stable position while worn around the user's neck.

The headset 400 can also include speakers 410*c*, 410*d* on the first arm portions 406*a*, 406*b*. In one embodiment, the speakers 410*c*, 410*d* are actuated only when the headset 300 is worn around the user's neck to direct sound upwardly toward the user's ears. For example, the headset 400 can include a gyro, accelerometer or other sensor that can measure the angular orientation, inclination or tilt of the support portion 402, for example relative to the speakers 410*a*, 410*b* of the headset 400. In another embodiment, actuating the pivoting or swivel mechanism 430 to move the second arm portions 408*a*, 408*b* to the second position (as illustrated by arrow M' in FIG. 17) can actuate a switch (not shown) to allow sound to be output via the speakers 410*c*, 410*d*. Optionally, actuating the pivoting or swivel mechanism to move the second arm portions 408*a*, 408*b* to the second position can actuate a switch (not shown) to disallow sound from being output via the speakers 410*a*, 410*b*. Optionally, actuating the pivoting or swivel mechanism to move the second arm portions 408*a*, 408*b* to the first position can actuate a switch (not shown) to allow sound to be output via the speakers 410*a*, 410*b*. Optionally, actuating the pivoting or swivel mechanism to move the second arm portions 408*a*, 408*b* to the first position can actuate a switch (not shown) to disallow sound from being output via the speakers 410*c*, 410*d*. In another embodiment, the speakers 410*c*, 410*d* can be turned on or off manually by the user via one or more switches on a control of the headset 400, such as the control 70 of the headset 100.

In use, the user can wear the headset 400 on their head like other headphones and can adjust the arms 403*a*, 403*b* relative to the bridge portions 404*a*, 404*b* to adjust the fit of the headset 400 to the user's head. In embodiments where the headset 400 includes the microphone boom 420 coupled to the headset 400, the user can also adjust the location of the microphone boom 420, as described above, to locate the input 422 proximate the user's mouth. The user can then take part in online video gaming utilizing the headset 400 and can use the controls (not shown, but can be similar to the controls 70 of the headset 100) to control the operation of the headset (e.g., volume level, stereo or mono selector). If the user plans on participating in an online gaming session for an extended period of time (e.g., 2 hours, 4 hours, 6 hours), the user can wear the headset 400 around their neck so that the support portion 402 rests on the back of the user's neck and/or shoulders, and so the first arm portions 406*a*, 406*b* rest on the user's shoulders and/or upper chest area. The user can move (e.g., pivot, swivel) the second arm portions 408*a*, 408*b* relative to the first arm portions 406*a*, 406*b* to position the speakers 410*a*, 410*b* facing the user's shoulders and/or upper chest (see FIG. 18). One of skill in the art will recognize that although the use of the headset above is described in connection with video gaming applications, the headset 100 is not limited for use to video gaming, but can be used in other suitable applications (e.g., listening to music, for receiving audio from a video player, for use with a personal or laptop computer).

Figure 19:
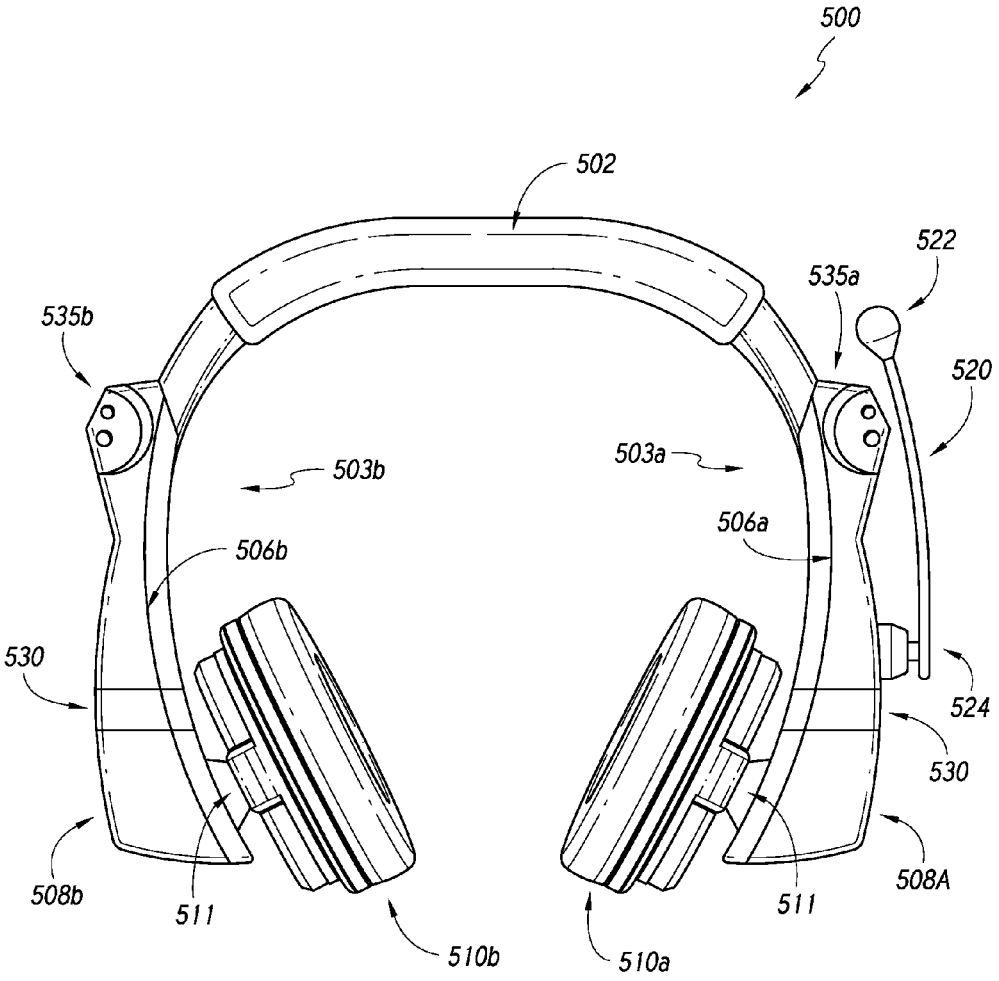
FIG. 19 is a schematic front view of another embodiment an adjustable headset or headphones, with the headphone speakers in a first orientation.
Figure 20:
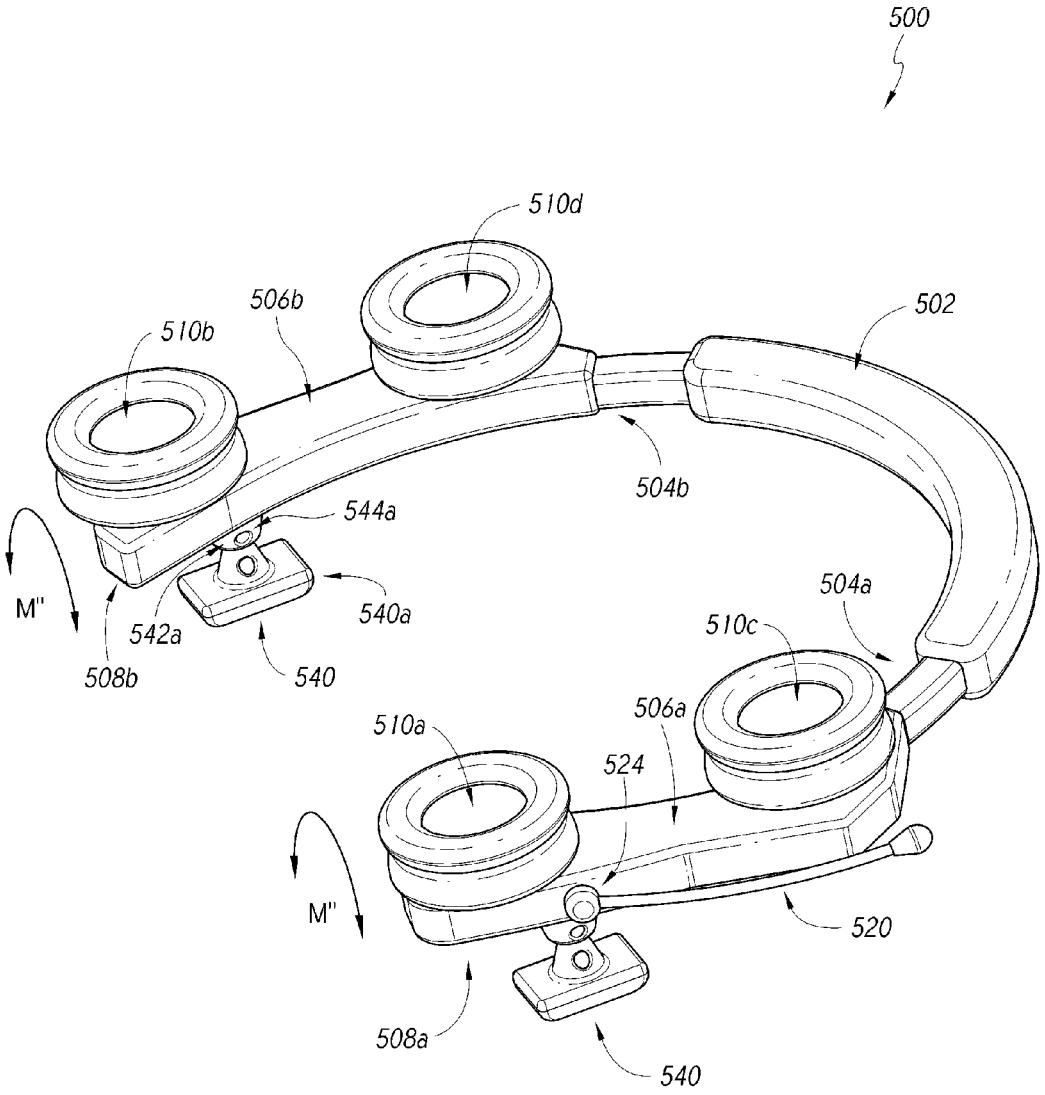
FIG. 20 is a schematic perspective top view of the adjustable headset of FIG. 19, with the headphone speakers in a second orientation and a second set of speakers attached to the arms of the headset.

FIGS. 19-20 show another embodiment of a headset or headphones 500. The headset 500 is similar to the headset 400, except as described below. The headset 500 can have a support portion 502 for supporting the headset 500 on the user's head when worn in a generally upright orientation by the user. The headset 500 can have a pair of arms 503*a*, 503*b* attached to the support portion 502. The support portion 502 can optionally be contoured to better fit over the user's head and/or around the user's neck. Optionally, the arms 503*a*, 503*b* can be movably (e.g., slidably) coupled to the support portion 502 via bridge portions 504*a*, 504*b* that allow the arms 503*a*, 503*b* to be extended relative to the support portion 502, thereby allowing the distance between the support portion 502 and speakers 510*a*, 510*b* to be adjusted to accommodate a variety of user head sizes and shapes. Optionally, the bridge portions 504*a*, 504*b* can be similar to the bridge portions 304*a*, 304*b* and have a connector (not shown), similar to the connector 380, that connects with the arms 503*a*, 503*b*.

The arms 503*a*, 503*b* can include first arm portions 506*a*, 506*b* and second arm portions 508*a*, 508*b*, where a proximal end of the first arm portions 506*a*, 506*b* are proximate (e.g., adjacent) the bridge portions 504*a*, 504*b*, and wherein a distal end of the first arm portions 506*a*, 506*b* are proximate (e.g., adjacent) the second arm portions 508*a*, 508*b*. The speakers 510*a*, 510*b* can be coupled to the second arm portions 508*a*, 508*b* via a connector 511. Optionally, the connector 511 allows the speakers 510*a*, 510*b* to swivel relative to the second arm portions 508*a*, 508*b*.

The headset 500 can also include a microphone boom 520 that extends between a diaphragm or input end 522 and a connector 524. Optionally, the microphone boom 520 can be removably coupled to the headset 500 via a microphone port (not shown), which can be similar to the microphone port 12 of the headset 100. The microphone boom 520 can be pivoted or moved relative to the arm 503*a* in the manner discussed above for other headset embodiments, and can have the same background noise filtering characteristics.

The headset 500 can include a pivoting or swivel mechanism 530 that allows the second arm portions 508*a*, 508*b* to pivot or swivel relative to the first arm portions 506*a*, 506*b* (see arrow M" in FIG. 20) to change the orientation of the speakers 510*a*, 510*b* relative to the first arm portions 506*a*, 506*b*. In one embodiment, the second arm portions 508*a*, 508*b* can be pivoted between a first position where the speakers 510*a*, 510*b* are oriented inwardly toward the user's ears (see FIG. 19) when the headset 500 is worn on the user's head and a second position where the speakers 510*a*, 510*b* are oriented upwardly (see FIG. 20) to direct sound upwardly toward the user's ears when the headset 500 is worn around the user's neck so that the arms 503*a*, 503*b* rest on the user's shoulders and/or upper chest area. The headset 500 can include support members 540 (similar to the support members 40 of the headset 100) that can include a support element 540*a*, which can include a soft or compressible material (e.g., foam). The support element 540*a* can be coupled (e.g., movably coupled) to a connector 542*a* attached to the rear side of the arms 503*a*, 503*b* via a fastener 544*a* (e.g., pin). The support members 540 can facilitate support of the headset 500 on the user when worn around the user's neck so that the headset 500 is maintained in a generally stable position while worn around the user's neck.

The headset 500 can also include speakers 510*c*, 510*d* (see FIG. 20) that can be removably coupled to connectors 535*a*, 535*b* on the first arm portions 506*a*, 506*b*. In one embodiment, the speakers 510*c*, 510*d* are actuated only when the headset 500 is worn around the user's neck to direct sound upwardly toward the user's ears. For example, the headset 500 can include a gyro, accelerometer or other sensor that can measure the angular orientation, inclination or tilt of the support portion 502, for example relative to the speakers 510*a*, 510*b* and/or second arm portions 508*a*, 508*b* of the headset 500. In another embodiment, actuating the pivoting or swivel mechanism 530 to move the second arm portions 508*a*, 508*b* to the second position (see FIG. 20) can actuate a switch (not shown) to allow sound to be output via the speakers 510*c*, 510*d* once attached to the connectors 540*a*, 540*b*. In still another embodiment, the speakers 510*c*, 510*d* can optionally be manually actuated by the user via one or more switches on a control of the headset 500 (e.g., similar to the controls 70 of the headset 100).

The speakers 510*c*, 510*d* can in one embodiment, mechanically couple (e.g., snap onto) the connectors 535*a*, 535*b*. In another embodiment, the speakers 510*c*, 510*d* can be magnetically coupled to the connectors 535*a*, 535*b* via one or more magnets for fast and easy coupling and decoupling of the speakers 510*c*, 510*d* from the arms 503*a*, 503*b*. Advantageously, the headset 500 provides an amplified directional speaker stereo headset that can operate up to four speakers (e.g., 510*a*, 510*b*, 510*c*, 510*d*) at once for a fuller gaming experience.

In use, the user can wear the headset 500 on their head like other headphones and can adjust the arms 503*a*, 503*b* relative to the bridge portions 504*a*, 504*b* to adjust the fit of the headset 500 to the user's head. In embodiments where a microphone boom 520 is coupled to the headset 500, the user can also adjust the location of the microphone boom 520, as described above, to locate the input 522 proximate the user's mouth. The user can then take part in online video gaming utilizing the headset 500 and can use the controls of the headset 500 (not shown, but can be similar to the controls 70 of headset 100) to control the operation of the headset (e.g., volume level, stereo or mono selector). If the user plans on participating in an online gaming session for an extended period of time (e.g., 2 hours, 4 hours, 6 hours), the user can wear the headset 500 around their neck so that the support portion 502 rests on the back of the user's neck and/or shoulders, and so the first arm portions 506*a*, 506*b* rest on the user's shoulders and/or upper chest area. The user can move (e.g., pivot, swivel) the second arm portions 508*a*, 508*b* relative to the first arm portions 506*a*, 506*b* to direct the speakers 510*a*, 510*b* generally upwards toward the user's ears to provide an improved sound experience while inhibiting ear fatigue and discomfort from prolonged use of the headset 500. As discussed above, the speakers 510*c*, 510*d* can also be operated to direct sound upward toward the user's ears and provide an improved sound experience. One of skill in the art will recognize that although the use of the headset above is described in connection with video gaming applications, the headset 500 is not limited for use to video gaming, but can be used in other suitable applications (e.g., listening to music, for receiving audio from a video player, for use with a personal or laptop computer).

The headset 100, 200, 300, 400, 500 can be made from suitable materials used in the manufacture of headsets or headphones (e.g., for gaming or general audio applications). For example, metals and/or plastics can be used in the manufacture of the headset 100, 200, 300, 400, 500.

In the embodiments disclosed above, one or more wires can interconnect the speakers (e.g., 10*a* with 10*b*, 210*a* with 210*b*, 410*a* with one or more of 410*b*, 410*c* and 410*d*, 510*a* with one or more of 510*b*, 510*c* and 510*d*) of the headset 100, 200, 300, 400, 500, for example, via the support portion 2, 202, 302, 402, 502. The pivoting mechanism 30, 30*a*, 30*b*, 230, 430, 530 can advantageously allow the orientation of the first arm portions 6*a*, 6*b*, 206*a*, 206*b*, 406*a*, 406*b*, 506*a*, 506*b* to be adjusted relative to the second arm portions 8*a*, 8*b*, 208*a*, 208*b*, 408*a*, 408*b*, 508*a*, 508*b* without affecting the wired interconnection between the speakers. In one embodiment, the wires can have sufficient slack to allow the first arm portions 6*a*, 6*b*, 206*a*, 206*b*, 406*a*, 406*b*, 506*a*, 506*b* to move relative to the second arm portions 8*a*, 8*b*, 208*a*, 208*b*, 408*a*, 408*b*, 508*a*, 508*b* without disconnecting the wires from the speakers. In another embodiment, the wires can pass along side one or more components of the pivoting mechanism 30, 30*a*, 30*b*, 230, 430, 530. In another embodiment, the wiring can optionally pass through a conduit of the pivoting mechanism 30, 30*a*, 30*b*, 230, 430, 530, such as the pin, shaft, axle or fastener 34 that interconnects the first arm portions 6*a*, 6*b*, 206*a*, 206*b*, 406*a*, 406*b*, 506*a*, 506*b* with the second arm portions 8*a*, 8*b*, 208*a*, 208*b*, 408*a*, 408*b*, 508*a*, 508*b*. In the embodiment where the pivoting mechanism is a ball and socket assembly, the wires can optionally pass along the central axis defined by ball and socket assembly to interconnect the first arm portions 6*a*, 6*b*, 206*a*, 206*b*, 406*a*, 406*b*, 506*a*, 506*b* with the second arm portions 8*a*, 8*b*, 208*a*, 208*b*, 408*a*, 408*b*, 508*a*, 508*b*.

Although this disclosure has been described in the context of certain embodiments and examples, it will be understood by those skilled in the art that the disclosure extends beyond the specifically disclosed embodiments to other alternative embodiments and/or uses and obvious modifications and equivalents thereof. In addition, while several variations of the embodiments of the disclosure have been shown and described in detail, other modifications, which are within the scope of this disclosure, will be readily apparent to those of skill in the art. It is also contemplated that various combinations or sub-combinations of the specific features and aspects of the embodiments may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. An adjustable headset, comprising:

a support portion configured to rest on a user's head when the headset is worn in an upright orientation and configured to rest on a user's shoulders when the headset is worn around the user's neck;

a pair of arm assemblies movably coupled to the support portion, each of the arm assemblies having a speaker at a distal portion thereof and comprising a first arm portion extending from the support portion to a distal end, a second arm portion extending adjacent the first arm portion, the speaker operatively coupled to a distal portion of the second arm portion, and a pivoting mechanism that movably couples the second arm portion to the first arm portion, the pivoting mechanism configured to allow the pivoting of the second arm portion outwardly away from the first arm portion, wherein the second arm portion is selectively pivotable between a first orientation where the first and second arm portions extend generally parallel to each other and a second orientation where the second arm portion extends at a non-parallel plane relative to the first arm portion, such that when the headset is worn around the user's neck and supported by the user's shoulders and/or upper chest, the second arm portions are positionable at said non-parallel plane relative to the first arm portions to position the speakers proximate the user's ears to thereby direct sound at the user's ears while not in contact with the user's ears to thereby inhibit ear fatigue and allow the user to hear ambient sound during use of the headset.

2. The adjustable headset of claim 1, further comprising a microphone removably coupleable to one of the arm assemblies.

3. The adjustable headset of claim 1, wherein the pivoting mechanism comprises a female member having one or more recesses attached to the second arm member and pivotably coupled to the first arm member, and a spring loaded ball housed at least partially in the support member, wherein the spring loaded ball is removably received in the one or more recesses to generally fix the angular orientation between the first arm portion and the second arm portion in a stable position until the second arm portion is pivoted to a different angular orientation so that the spring loaded ball is received in a different recess of the female member.

4. The adjustable headset of claim 1, wherein the pivoting mechanism comprises a ratchet mechanism with a gear on one of the first arm portion and second arm portion and a pawl that releasably engages the gear.

5. The adjustable headset of claim 1, wherein the second arm portion is selectively pivotable along a plane generally parallel to a plane of the first arm portion.

6. The adjustable headset of claim 1, wherein each of the arm assemblies comprises a support member coupled to a rear surface of the first arm portion, said support member configured to support the headset on the user's upper chest area when the headset is worn around the user's neck.

7. The adjustable headset of claim 6, wherein the support member comprises a contoured rear surface of the first arm portion.

8. The adjustable headset of claim 1, further comprising a control unit housed in one of the arm assemblies, the control unit actuatable to adjust one or more operating parameters of the headset.

9. The adjustable headset of claim 1, wherein the second arm portion is disposed inwardly of the first arm portion.

10. An adjustable headset, comprising:

a support portion configured to rest on a user's head when the headset is worn in an upright orientation and configured to rest on a user's shoulders when the headset is worn around the user's neck;

a pair of arm assemblies movably coupled to the support portion, each of the arm assemblies having a speaker at a distal portion thereof and comprising a first arm portion extending from the support portion to a distal end, a second arm portion extending adjacent the first arm portion, the speaker operatively coupled to a distal portion of the second arm, and means for pivoting the second arm portions outwardly relative to the first arm portions between a first orientation when the headset is worn on the user's head and a second orientation, different than the first orientation, when the headset is worn around the user's neck, such that when the headset is worn around the user's neck and supported by the user's shoulders and/or upper chest, the second arm portions are positionable outwardly away from the first arm portions along a non-parallel plane to the first arm portions so that the speakers are oriented toward the user's ears to thereby direct sound at the user's ears while not in contact with the user's ears to thereby inhibit ear fatigue and allow the user to hear ambient sound during use of the headset.

11. The adjustable headset of claim 10, wherein each of the second arm portions pivots along a plane generally parallel to a plane of its corresponding first arm portion.

12. The adjustable headset of claim 10, wherein each of the arm assemblies comprises a support member coupled to a rear surface of the first arm portion, said support member configured to support the headset on the user's upper chest area when the headset is worn around the user's neck.

13. The adjustable headset of claim 12, wherein the support member comprises a contoured rear surface of the first arm portion.

14. The adjustable headset of claim 10, further comprising a control unit housed in one of the arm assemblies, the control unit actuatable to adjust one or more operating parameters of the headset.

15. The adjustable headset of claim 10, wherein the second arm portion is disposed inwardly of the first arm portion.

16. An adjustable headset, comprising:

a support portion configured to rest on a user's head when the headset is worn in an upright orientation and configured to rest on a user's shoulders when the headset is worn around the user's neck;

a pair of arm assemblies movably coupled to the support portion, each of the arm assemblies having a speaker at a distal portion thereof and comprising a first arm portion extending distally from the support portion, a second arm portion movably attached to the first arm portion, the speaker operatively coupled to the second arm, and a pivoting mechanism that movably couples the second arm portion to the first arm portion, the pivoting mechanism configured to allow the pivoting of the second arm relative to the first arm portion to position the speakers outwardly, wherein the second arm portion is selectively pivotable between a first orientation where the speakers are directed inwardly toward the user's ears when the headset is worn on the user's head and a second orientation different than the first orientation when headset is worn around the user's neck and supported by the user's shoulders and/or upper chest so that the speakers direct sound at the user's ears while not in contact with the user's ears to thereby inhibit ear fatigue and allow the user to hear ambient sound during use of the headset.

17. The adjustable headset of claim 16, wherein in the second orientation one or more support members face downward toward the user's upper chest area and provide support for the headset while worn around the user's neck.

18. The adjustable headset of claim 16, wherein in the second orientation the speakers face upward to direct sound upward toward the user's ears.

19. The adjustable headset of claim 16, further comprising a second set of speakers attached to the first arm portions proximate the support portion, the second set of speakers configured to direct sound upward toward the user's ears when the headset is worn around the user's neck.

20. The adjustable headset of claim 19, wherein the second set of speakers are removably coupleable to the first arm portions.

* * * * *